US012703829B2

(12) United States Patent
Keturakis et al.

(10) Patent No.: US 12,703,829 B2
(45) Date of Patent: Aug. 11, 2026

(54) HYDROCARBON UPGRADING PROCESS

(71) Applicant: UOP LLC, Des Plaines, IL (US)

(72) Inventors: Christopher J. Keturakis, Arlington Heights, IL (US); Suheil F. Abdo, Lincolnshire, IL (US); Anant Patel, Schaumburg, IL (US); Anisha Chakrabarti Erekson, Arlington Heights, IL (US); Seshasayanam Prabhakar, Hoffman Estates, IL (US); Nicholas Mielke, Mount Prospect, IL (US); Avram M. Buchbinder, Chicago, IL (US); Ping Sun, Hinsdale, IL (US); Joseph Kozlowski, Brookfield, IL (US); Matthew J. Kline, Darien, IL (US)

(73) Assignee: UOP LLC, Rosemont, IL (US)

( * ) Notice: Subject to any disclaimer, the term of this patent is extended or adjusted under 35 U.S.C. 154(b) by 0 days.

(21) Appl. No.: 18/905,954

(22) Filed: Oct. 3, 2024

(65) Prior Publication Data

US 2026/0098222 A1 Apr. 9, 2026

Related U.S. Application Data

(60) Provisional application No. 63/629,986, filed on Dec. 15, 2023.

(51) Int. Cl.
*C10G 69/02* (2006.01)

(52) U.S. Cl.
CPC ..... *C10G 69/02* (2013.01); *C10G 2300/1011* (2013.01); *C10G 2300/4081* (2013.01); *C10G 2300/4093* (2013.01)

(58) Field of Classification Search
CPC ..... C10G 69/02; C10G 2300/1011; C10G 2300/4081; C10G 2300/4093
See application file for complete search history.

(56) References Cited

U.S. PATENT DOCUMENTS 3,544,448 A * 12/1970 Jacobs ..... C10G 65/08 208/59
8,022,259 B2 9/2011 Bauer et al.
(Continued)

FOREIGN PATENT DOCUMENTS

CA 2864057 C * 8/2018 ..... C10G 69/126
CN 102911698 B 2/2013
(Continued)

OTHER PUBLICATIONS

Search Report and Written Opinion for PCT/US2024/059530 dated Mar. 28, 2025.

*Primary Examiner* — Prem C Singh
*Assistant Examiner* — Juan C Valencia
(74) *Attorney, Agent, or Firm* — Paschall & Associates, LLC; James C. Paschall

(57) ABSTRACT

A process for upgrading a bio-oil stream is disclosed. The process comprises reacting a bio-oil stream with hydrogen in the presence of a catalyst in a reactor to produce an upgraded bio-oil stream. The upgraded bio-oil stream is charged to an FCC unit, a hydroprocessing unit, or a reforming unit to produce an intermediate blend or a fuel stream. A fuel oil stream can be taken from the upgraded bio-oil stream. The catalyst may be separated and recycled to the reactor. The upgraded bio-oil stream can be used directly to produce an intermediate blend or fuel. A fuel oil stream may be taken from the upgraded bio-oil stream.

21 Claims, 5 Drawing Sheets

(56) References Cited

U.S. PATENT DOCUMENTS

| | | | | |
|---|---|---|---|---|
| 2014/0288338 | A1* | 9/2014 | Radlein | C10G 3/50<br>585/254 |
| 2022/0010219 | A1* | 1/2022 | Wang | G01J 3/2823 |

FOREIGN PATENT DOCUMENTS

| | | | |
|---|---|---|---|
| CN | 112552965 | A | 3/2021 |
| WO | 2014143377 | A1 | 9/2014 |
| WO | 2018058172 | A1 | 4/2018 |

* cited by examiner

HYDROCARBON UPGRADING PROCESS

FIELD

The field is related to a process for upgrading a bio-oil stream. Particularly, the field relates to a process for upgrading a bio-oil stream to be used as fuel oil or for treatment in an FCC unit, or a hydroprocessing unit or a reforming unit.

BACKGROUND

Hydrocarbon conversion processes typically require reactor systems, and associated conduits and piping, adapted for hydrocracking, reforming, fluidized catalytic cracking, and other similar processes.

Bio-oils are obtained by thermochemical liquefaction, notably pyrolysis, such as flash, fast, slow or catalytic pyrolysis. Pyrolysis is a thermal decomposition process in the absence of oxygen with thermal cracking of the feedstocks to gas, liquid and solid products. A catalyst can be added to enhance the conversion in a so-called catalytic pyrolysis. Various technologies have been deployed for large scale biomass pyrolysis. They include bubbling fluidized beds, circulating fluidizing beds, ablative pyrolysis, vacuum pyrolysis, and rotating cone pyrolysis reactors. Catalytic pyrolysis generally leads to bio-oil having a lower oxygen content than bio-oil obtained by thermal decomposition. The selectivity between gas, liquid and solid is well related to the reaction temperature and vapor residence time. Lower temperature, for example, around 400° C. and longer residence time, for example, a few minutes to a few hours, obtained by slow pyrolysis, favors the production of solid product, also called char or char coal, with typically 35 wt % gas, 30 wt % liquid, and 35 wt % char. Very high temperature of above 800° C. used in the gasification processes favors gas production (typically more than 85 wt %). Intermediate reaction temperature (typically about 450° C. to about 550° C.) and short vapor residence time (typically about 10 to about 20 s), for the so-called pyrolysis, favor the liquid yield: typically 30 wt % gas, 50 wt % liquid, and 20 wt % char. Intermediate reaction temperature (typically about 450° C. to about 550° C.) and very short vapor residence time (typically about 1 to about 2 s) for the so-called flash pyrolysis or fast pyrolysis, favor even more the liquid yield: typically 10 to about 20 wt % gas, about 60 to about 75 wt % liquid, about 10 to about 20 wt % char. The highest liquid yields may be obtained by the flash pyrolysis processes, with up to 75 wt %.

Bio-oils can be processed to provide low-cost renewable liquid fuels; indeed, they can be used as fuel for boilers, as well as for stationary gas turbines and diesel engines. Furthermore, fast pyrolysis has been demonstrated at fairly large scales, of the order of several hundred tons per day. Nevertheless, there has not been any significant commercial uptake of this technology. The reasons may relate mostly to the poor physical and chemical properties of bio-oils in general and fast pyrolysis bio-oils in particular. For example, some of the undesirable properties of pyrolysis bio-oils may include: (1) corrosivity on account of their high water and acidic contents; (2) relatively low specific calorific value on account of the high oxygen content, which typically is around 40% by mass; (3) chemical instability on account of the abundance of reactive functional groups like the carboxyl group and phenolic groups that can lead to polymerization on storage and consequent phase separation; (4) relatively high viscosity and susceptibility to phase separation under high shear conditions, for instance in a nozzle; (5) incompatibility with, on account of insolubility in, conventional hydrocarbon based fuels; (6) blockage in nozzles and pipes caused by adventitious char particles, which will always be present in unfiltered bio-oil to a greater or lesser degree. All these aspects combine to render bio-oil handling, shipping storage and usage difficult and expensive.

The economic viability of bio-oil production for fuel or energy applications therefore depends on finding appropriate methods to upgrade it to a higher quality liquid fuel at a sufficiently low cost.

Over the last two decades, the approach of direct hydroprocessing of bio-oil to convert it to stable oxygenates or hydrocarbons has been studied intensively. A major obstacle to the catalytic hydroprocessing of bio-oil has been its propensity to polymerize under heating above about 100° C., leading ultimately to the formation of extraneous solids or coke at temperatures above about 140° C., with consequences like reactor plugging and catalyst deactivation.

Therefore, there is a need for an improved process for bio-oil hydroprocessing that minimizes the formation of solids and catalyst deactivation and provides an upgrade deoxygenated oil product that can be used for producing useful fuels.

SUMMARY

The present disclosure provides a process for upgrading a bio-oil stream. The process comprises reacting a bio-oil stream with hydrogen in the presence of a catalyst in a reactor to produce an upgraded bio-oil stream. The upgraded bio-oil stream may be taken as a fuel oil or charged to an FCC unit, a hydroprocessing unit, or a reforming unit to produce an intermediate blend or a fuel stream. A fuel oil stream can be taken from the upgraded bio-oil stream. The catalyst may be separated and recycled to the reactor. The upgraded bio-oil stream can be used directly to produce an intermediate blend or fuel. A stream may be taken from the upgraded bio-oil stream and analyzed to measure the concentration of selected constituents and compared to predetermined ranges. If the measured values fall within a predetermined range, the upgraded bio-oil stream can be used directly as fuels or charged to an FCC unit, a hydroprocessing unit, reforming unit, or other downstream processing unit to produce one or more intermediate blends and fuels. A recycle stream may be recycled to the reactor to offset a petroleum feed stream.

DEFINITIONS

Figure 1:
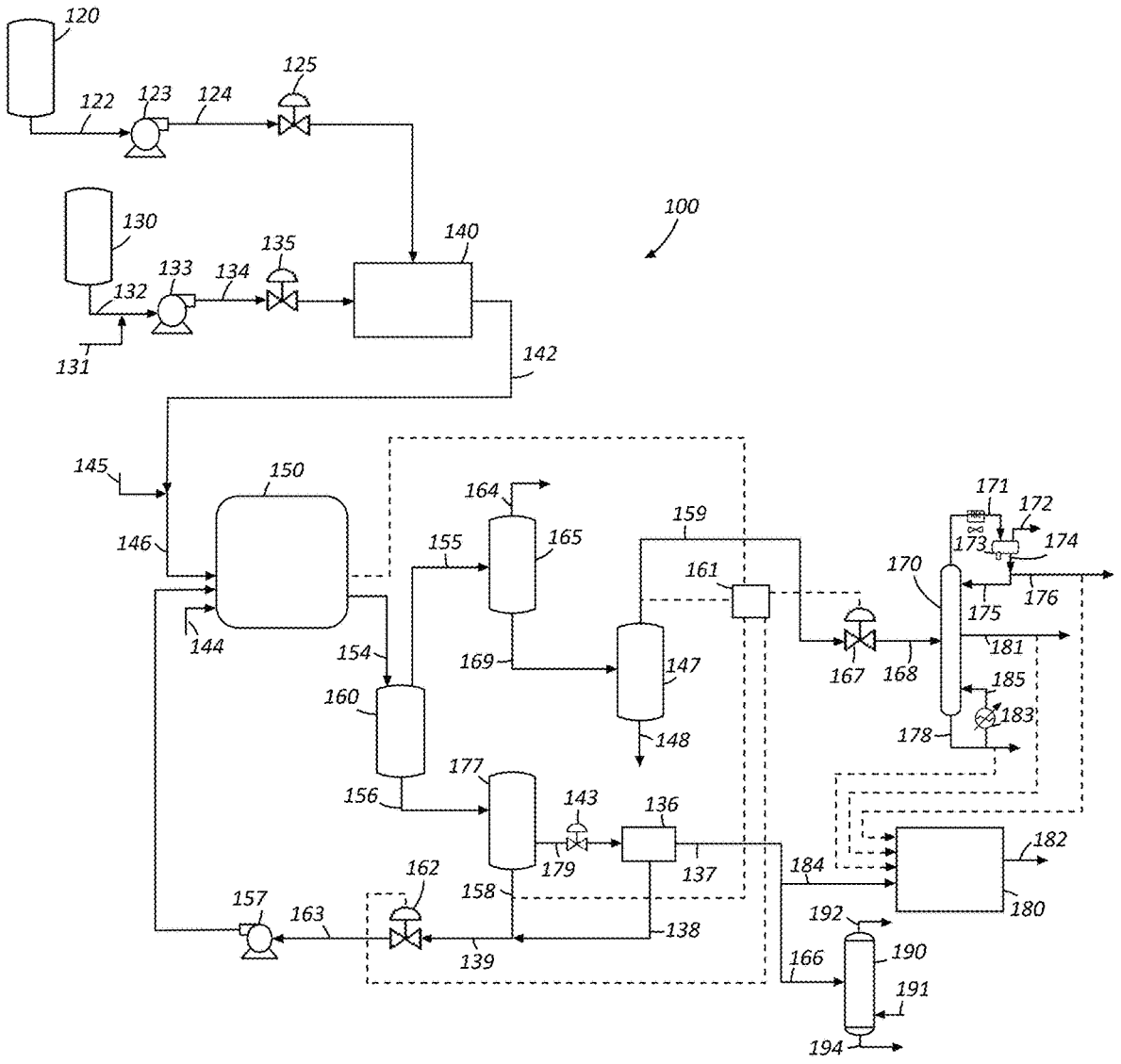
FIG. 1 illustrates a schematic diagram of the process for upgrading a bio-oil stream in accordance with an exemplary embodiment of the present disclosure.

As used herein the terms "reactor", "process equipment," "process units," or "reactor components" shall include any and all process equipment and process units that are utilized in hydrocarbon conversion processes including any upstream and/or downstream equipment from the particular unit and/or ancillaries, such as furnace tubes, associated piping, heat exchangers, heater tubes, and the like.

As used herein, the term "predominant" or "predominate" or "predominance" means greater than 50%, suitably greater than 75% and preferably greater than 90%.

As used herein, the term "carbon number" refers to the number of carbon atoms per hydrocarbon molecule and typically a paraffin molecule.

As used herein, "petroleum stream" or "petroleum feedstock" may refer to crude oil, crude oil refinery distillates, crude oil refinery residue, cracked products or hydrocarbons from a crude oil refinery, liquefied coal, bitumen, typically extracted from the ground or sea floor.

As used herein, the term "True Boiling Point" (TBP) means a test method for determining the boiling point of a material which corresponds to ASTM D-2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "T10" or "T90" means the temperature at which 10 mass percent or 90 mass percent, as the case may be, respectively, of the sample boils using ASTM D-86 or TBP.

As used herein, the term "vacuum gas oil" (VGO) includes hydrocarbons having an initial boiling point above approximately 343° C. (650° F.), with a T10 boiling point temperature using ASTM D1160 of approximately 370° C. (698° F.) and a T90 boiling point temperature using ASTM D1160 of approximately 500° C. (932° F.).

As used herein, the term "stable oil" means an upgraded oil having the desired concentration of functional groups or properties that make it useful directly as a fuel or to produce an intermediate blend or fuel stream that can be transported or processed in a refinery process unit.

As used herein, the terms "mol % H" and "mol % C" refer to the percentage of moles of hydrogen or carbon atoms, respectively, of the total moles of hydrogen or carbon atoms in oil. For example, if the bio-oil composition contains 5 moles of hydrogen atoms and 10 moles of carbon atoms and it is said that the bio-oil contains 10 mol % H of aldehydes and 20 mol % C of carboxylic acids and esters it means that 0.5 moles of hydrogen atoms in the bio-oil correspond to H atoms of molecules with an aldehyde functional group and 2 moles of carbon atoms in the bio-oil correspond to C atoms of molecules with either a carboxylic acid or ester functional group.

As used herein, the term "bioderived" or "biogenic" material means a material that comes from or made of, but not limited to, plants, animals, microorganisms, algae, or biopolymers.

As used herein, the term "recycle ratio" or "recycle rate" means the ratio of the recycle flow rate to the fresh feed flow rate.

DETAILED DESCRIPTION

Biocrude or bio-oil polymerization during deoxygenation or hydrotreating reactions is a major challenge when attempting to convert bio-oil to fuels. The present disclosure provides a process to upgrade a biomass-based feed such as bio-oil to produce an upgraded bio-oil. The upgraded bio-oil can be used directly as fuel oil such as marine fuel. Alternatively, the upgraded bio-oil can be used as a feed stock for an FCC unit, a hydroprocessing unit, or a reforming unit to produce an intermediate blend or fuel. The upgrading process may include various analyses such as to generate spectroscopy data to identify molecular functional groups that are responsible for bio-oil polymerization. Identification and tracking of functional group evolution as a function of catalyst or process conditions helps in targeting the groups responsible for rapid polymerization and charring providing the potential to selectively eliminate them thereby enhancing the performance of the upgrading process. As described later in detail, the process comprises converting the oxygenate groups present in the feed, for example, to control charring potential.

Bio-oil perhaps derived from lignocellulosic biomass is a complex mixture of compounds, including oxygenates, that are obtained from the breakdown of biopolymers in biomass. Bio-oils can be derived from plants such as grasses and trees, wood chips, chaff, grains, grasses, corn, corn husks, weeds, aquatic plants, hay and other sources of lignocellulosic material, such as derived from municipal waste, food processing wastes, forestry wastes and cuttings, energy crops, or agricultural and industrial wastes (such as sugar cane bagasse, oil palm wastes, sawdust or straws). Bio-oils can also be derived from pulp and paper byproducts (recycled or not). Bio-oils are generally obtained from these biomass feeds by thermochemical liquefaction, notably pyrolysis, such as flash, fast, slow or catalytic pyrolysis. Hydrothermal liquefaction may also be utilized to generate bio-oil feeds. Several different processes which produce bio-oil can be utilized to produce biocrude feed.

Bio-oil is a highly oxygenated, polar hydrocarbon product that typically contains at least about 10 mass % oxygen, typically about 10 to 60 mass % oxygen, more typically about 30 to about 50 mass % oxygen on a water-free basis. In general, bio-oil comprises oxygenates that may include alcohols, aldehydes, ketones, acetates, ethers, esters, organic acids and aromatic oxygenates. Oxygen is also present as free water which constitutes at least about 10 mass %, typically about 15 to about 35 mass % of the bio-oil. These properties render bio-oil immiscible with fuel grade hydrocarbons, even with aromatic hydrocarbons, which typically contain little or no oxygen.

In an aspect of the present disclosure, the biomass-based feed stream may comprise a bio-oil stream obtained by pyrolysis of a biomass feedstock.

The biomass-based feed stream in the present disclosure may further contain other oxygenates derived from biomass such as vegetable oils or animal fat derived oils. Vegetable oil or animal fat-derived oil comprises fatty matter and therefore correspond to a natural or elaborate substance of animal or vegetable origin, mainly containing triglycerides. This essentially involves oils from renewable resources such as fats and oils from vegetable and animal resources (such as lard, tallow, fowl fat, bone fat, fish oil and fat of dairy origin), as well as the compounds and the mixtures derived therefrom, such as fatty acids or fatty acid alkyl esters. The products resulting from recycling of animal fat and of vegetable oils from the food processing industry can also be used, pure or in admixture with other constituent classes described above. The feeds may comprise vegetable oils from oilseed such as rape, erucic rape, soybean, jatropha, sunflower, palm, copra, palm-nut, arachidic, olive, corn, cocoa butter, nut, linseed oil or oil from any other vegetable. These vegetable oils very predominantly consist of fatty acids in form of triglycerides (generally above 97% by mass) having long alkyl chains ranging from 8 to 24 carbon number, such as butyric fatty acid, caproic, caprylic, capric, lauric, myristic, palmitic, palmitoleic, stearic, oleic, linoleic, linolenic, arachidic, gadoleic, eicosapentaenoic (EPA), behenic, erucic, docosahexaenoic (DHA) and lignoceric acids. The fatty acid salt, fatty acid alkyl ester and free fatty acid derivatives such as fatty alcohols that can be produced by hydrolysis, by fractionation or by transesterification, for example, of triglycerides or of mixtures of these oils and of their derivatives also come into the definition of the "oil of vegetable or animal origin" feed in the present disclosure. All products or mixtures of products resulting from the thermochemical conversion of algae or products from the hydrothermal conversion of lignocellulosic biomass or algae (in the presence of a catalyst or not) or pyrolytic lignin are also feeds that can be used.

Moreover, the feed containing bio-oil can be coprocessed with petroleum and/or coal derived hydrocarbon feedstocks. The petroleum derived hydrocarbon feed stock can be straight run vacuum distillates, vacuum distillates from a conversion process such as those from coking, from fixed bed hydroconversion or from ebullated bed or slurry hydrocracking heavy fraction hydrotreatment processes, or from solvent deasphalted oils. The feeds can also be formed by mixing those various fractions in any proportions in particular deasphalted oil and vacuum distillate. They can also contain products from the fluid catalytic cracking units, such as light cycle oil (LCO) of various origins, heavy cycle oil (HCO) of various origins and any distillate fraction from fluid catalytic cracking generally having a distillation range of about 150° C. to about 370° C. They may also contain aromatic extracts and paraffins obtained from the manufacture of lubricating oils. The coal derived hydrocarbon feedstock can be products from the liquefaction of coal. Aromatics fractions from coal pyrolysis or coal gasification can also be used as bio-mass based feed.

FIG. 1 shows an exemplary embodiment of the process for upgrading a bio-oil stream. A bio-oil stream is taken in line 122 from a source, for example, a bio-oil storage drum 120. The bio-oil stream in line 122 may be passed to a mixer 140. Perhaps, the bio-oil stream in line 122 may be pumped via a pump 123 and a pumped bio-oil stream in line 124 be passed to the mixer 140. In an aspect, a control valve 125 is provided for maintaining a required flow rate of the bio-oil stream to the mixer 140.

In accordance with the present disclosure, a non-bio derived feed stream may also be passed to the mixer and mixed with the bio-oil stream. In an embodiment of the present disclosure, a petroleum stream is the non-bio derived feed stream. The petroleum stream is taken in line 132 from a source, for example, a petroleum storage drum 130. The petroleum stream in line 132 may be passed to the mixer 140. Perhaps the petroleum stream in line 132 may be pumped via a pump 133 and a pumped petroleum stream in line 134 is passed to the mixer 140. In an aspect, a control valve 135 is provided for maintaining a required flow rate of the petroleum stream to the mixer 140. In an embodiment, a sulfur source comprising a sulfiding agent in line 131 may be added to the petroleum stream in line 132 or the bio-oil stream in line 122 and passed to the mixer 140. The control valves 125 and 135 can be used to control or adjust the proportions of the bio-oil and the petroleum stream fed to the mixer 140. In an aspect, the petroleum stream in line 132 may be characterized as a stable oil stream having a desired concentration of the functional groups such as oxygenates.

In the mixer 140, the bio-oil stream in line 124 and the petroleum stream in line 134 are mixed and kept well mixed at a ratio perhaps with an excess of the petroleum stream at the startup of the process. In an embodiment, the bio-oil stream in line 124 and the petroleum stream in line 134 are mixed in the mixer 140 at a mass ratio of the bio-oil stream and the petroleum stream of about less than 1 at the start-up to provide a mixed stream. After mixing, a mixed stream in line 142 is taken from the mixer 140. In an aspect, the mixed stream 142 comprises the bio-oil stream and the petroleum stream in a ratio of about 0:100 to about 80:20 by mass at start-up. In an exemplary embodiment, the petroleum stream in line 134 is vacuum gas oil (VGO). The mixed stream in line 142 may be reacted with hydrogen in the presence of a catalyst in a reactor to produce an upgraded bio-oil stream.

In an embodiment, the mixed stream in line 142 is passed to a liquid phase hydrotreating (LPH) reactor 150. As described later in detail, a recycle stream in line 163 may also be passed to the reactor 150. A hydrogen stream in line 144 may also passed to the reactor 150. In an embodiment, the hydrogen stream in line 144 may be blended or mixed with the mixed stream in line 142 and passed to the reactor 150. A catalyst stream in line 145 may also be passed to the reactor 150. In an embodiment, the catalyst stream may be blended or mixed with the mixed stream in line 142 to provide a combined stream in line 146 which is passed to the reactor 150. In another embodiment, the catalyst stream 145 may be added to the recycle stream in line 163 to provide a combined recycle stream which is passed to the reactor 150. In the reactor 150, the petroleum stream, the bio-oil stream, the recycle stream, and the hydrogen stream may be reacted over a catalyst in a continuous liquid phase to provide an upgraded bio-oil stream in line 154. At least 50 wt % of the upgraded bio-oil stream is bio-derived. Preferably, 100 wt % of the upgraded bio-oil stream is bio-derived.

The upgraded bio-oil stream in line 154 may be charged to an FCC unit, a hydroprocessing unit, or a reforming unit to produce an intermediate blend or a fuel stream as described later in detail. Or a fuel oil stream may be taken from the upgraded bio-oil stream in line 154. In an aspect, a portion of the upgraded bio-oil stream in line 154 may be taken and charged to the FCC unit, the hydroprocessing unit, or the reforming unit to produce the intermediate blend or the fuel stream. Another portion of the upgraded bio-oil stream in line 154 may be taken as a fuel oil stream.

In an exemplary embodiment, the upgraded bio-oil stream in line 154 may be separated into a light upgraded bio-oil stream in line 159 and a heavy upgraded bio-oil stream in line 179.

Liquid phase hydrotreating (LPH) is used for upgrading the heavy hydrocarbon feedstocks to produce distillate products. The hydrotreating catalyst typically comprises a solid particulate compound of a catalytically active metal, metal sulfide, or a metal in elemental form, either alone or supported on a refractory material such as an inorganic metal oxide (e.g., alumina, silica, titania, zirconia, and mixtures thereof). Other suitable refractory materials include carbon, coal, and clays. Zeolites and non-zeolitic molecular sieves are also useful as solid supports. One advantage of using a solid particulate either alone or supported is its ability to act as a "coke getter" or adsorbent of asphaltene precursors that have a tendency to foul process equipment upon precipitation.

Catalytically active metals for use in LPH include those from Group IVB, Group VB, Group VIB, Group VIIB, or Group VIII of the Periodic Table, which are incorporated in the heavy hydrocarbon feedstock in amounts effective for catalyzing desired hydrotreating reactions to provide, for example, lower boiling hydrocarbons that may be fractionated from the LPH effluent as naphtha and/or distillate products in the substantial absence of the solid particulate. Representative metals include iron, nickel, molybdenum, vanadium, tungsten, cobalt, ruthenium, and mixtures thereof. The catalytically active metal may be present as a solid particulate in elemental form or as an organic compound or an inorganic compound such as a sulfide (e.g., iron sulfide) or other ionic compound. Metal or metal compound nanoaggregates may also be used to form the solid particulates.

In some embodiments, the metal compounds can be formed in situ, as solid particulates, from a catalyst precursor such as a metal sulfite (e.g., iron sulfite monohydrate) that decomposes or reacts in the LPH reaction zone environment, or in a pretreatment step, to form a desired, well-dispersed and catalytically active solid particulate (e.g., as iron sulfide). Catalyst precursors also include oil-soluble organometallic compounds containing the catalytically active metal of interest that thermally decompose to form the solid particulate (e.g., iron sulfide) having catalytic activity. Such compounds are generally highly dispersible in the heavy hydrocarbon feedstock and normally convert under pretreatment or LPH reaction conditions to the solid particulate that is contained in the slurry effluent. Catalyst precursors also include oil-soluble organometallic compounds, inorganic molybdenum compounds, or chelated metal compounds containing the catalytically active metal. Molybdenum chelates including molybdenum octoate, molybdenum dithiocarbamate, and molybdenum naphthenate and molybdenum compounds such as ammonium heptamolybdate and phosphomolybdic acid thermally decompose to form the solid particulate through reaction with sulfidation components in the feed or other sulfidation additives such as dimethyl disulfide, di-tert-butyl (poly) sulfide, dibenzyl disulfide, (di)allyl (di)sulfide, ammonium sulfite, dimethyl sulfite, dithiothreitol, elemental sulfur or thiourea to form, for example, molybdenum disulfide having catalytic activity. An exemplary in situ solid particulate preparation, involving pretreating, the heavy hydrocarbon feedstock and precursors of the ultimately desired metal compound, is described, for example, in U.S. Pat. No. 5,474,977.

In another aspect, a catalyst precursor with the sulfidation component or the sulfidation additive may be provided in a line 131 and added to the petroleum stream in line 132. In another aspect, a catalyst or a catalyst precursor may be added to the feed stream in line 122 or the petroleum stream in line 132.

Alternatively, such metal sulfides or other active metal compounds can be formed ex-situ or in a separate process step through typical methods for producing metal sulfides. One such method includes hydrothermal synthesis where a molybdenum compound and sulfidation component are added to water with an additional reducing agent such as citric acid, oxalic acid, or hydrochloric acid or gaseous hydrogen. In some cases, the sulfidation component may also act as a reducing agent such as thiourea, ammonium sulfite, dimethyl sulfite, or dithiothreitol. The hydrothermal synthesis solution may be loaded into an autoclave reactor and sealed. If gaseous hydrogen is the reducing agent, the autoclave reactor can be pressurized from about 1378 kPag (200 psig) to about 10342 kPag (1500 psig) with hydrogen gas or the hydrogen gas can flow and bubble through the autoclave reactor. The autoclave reactor is then heated to a synthesis temperature of about 200° C. to about 300° C. under the foregoing hydrogen or inert gas pressure and held at the synthesis temperature for about 0.5 to about 16 hours. The autoclave reactor is allowed to cool to room temperature before depressurization and unloading. The solid catalyst can be collected such as by centrifugation, filtration, or drying. An example of hydrothermal metal sulfide synthesis is described in J. Espano, Phase Control in the Synthesis of Iron Sulfides, 145 J. Am. Chem. Soc. 18948-18955 (2023).

Another such method of forming metal sulfides ex situ could be a sulfiding procedure in a fixed bed reactor. Such methods involve loading a fixed bed reactor with a powdered or pelletized molybdenum compound and flowing a sulfiding gas, such as hydrogen sulfide, or a sulfiding liquid, such as oil doped with a sulfiding agent over the catalyst bed. The fixed bed reactor is heated to a sulfiding temperature of about 200° C. to about 350° C., for example, under the flow of sulfiding gas and/or hydrogen gas. The reactor is either pressurized before or after heating to sulfiding temperature to a pressure of about 1378 kPag (200 psig) to about 13790 kPag (2000 psig). The reactor may be heated slowly at, for example, 1° C./min and held at any temperature setpoints along the way to reach the final sulfiding temperature. The reactor may be held at temperature setpoints for hours to days. Once the sulfiding is complete, the reactor is cooled to room temperature and the catalyst is unloaded from the reactor in its metal sulfide form. The sulfided catalyst may be further reduced in particle size via grinding, milling, or other methods, so that it is a fine powder and highly dispersible.

Yet another method of forming metal sulfides ex situ could be a sulfiding procedure relying on chemical vapor deposition techniques. Such a method involves molybdenum compounds such as molybdenum trioxide, molybdenum dioxide, molybdenum foil, or dipotassium tetrathiomolybdate and sulfur compounds such as elemental sulfur, alkali sulfates, alkaline earth sulfates, or other metal sulfates or similar metal sulfites. A substrate is also used such as $SiO_2$/Si wafers, graphenes/graphites, or powdered or pelletized substrates commonly used as catalyst supports such as $SiO_2$, $Al_2O_3$, or $TiO_2$. Using a typical tube furnace synthesis reactor, the reactants and supports are placed in the reactor tube in a specific order with the sulfur source first (furthest upstream) followed by the molybdenum source downstream followed by the substrate further downstream. All compounds mentioned above are placed in a thermal zone in the tube furnace, typically in ceramic or other thermally and chemically resistant holders, which may be controlled as independent zones or as one zone. The substrate may be placed outside a thermal zone, if desired. This positioning is such that a gas flow through the tube first contacts the sulfur source, followed by the molybdenum source, followed by the substrate. A gas flow could include inert gas, hydrogen, steam, and/or oxygen/air. In typical operation, a gas flow is started and the tube furnace reactor zones are heated to a temperature that is suitable to vaporize one or more of the compounds mentioned above at ambient pressure, typically equal to or less than 1000° C. The compounds vaporize and flow downstream where they react with each other and deposit on the substrate. The synthesis may run until complete consumption of all reactants or the substrate may be moved in and out of the apparatus so that the deposition time is limited to several minutes. After synthesis completion, the resulting metal sulfide is collected by removal of the substrate holder. The metal sulfide catalyst can be used as-is or, in the case of depositions of flat substrates like silicon wafers, the catalyst powder may be optionally scraped off for use without the silicon wafer. An example of chemical vapor deposition metal sulfide synthesis is described in W. Fu, Toward Edge Engineering of Two-Dimensional Layered Transition-Metal Dichalcogenides by Chemical Vapor Deposition," 17 (17) ACS Nano 16348-16368 (2023).

Other suitable precursors include metal oxides that may be converted to catalytically active (or more catalytically active) compounds such as metal sulfides. In a particular embodiment, a metal oxide containing mineral may be used as a precursor of a solid particulate comprising the catalytically active metal (e.g., iron sulfide) on an inorganic refractory metal oxide support (e.g., alumina). Bauxite represents a particular precursor in which conversion of iron oxide crystals contained in this mineral provides an iron sulfide catalyst as a solid particulate, where the iron sulfide after conversion is supported on the alumina that is predominantly present in the bauxite precursor.

The active metals employed in the hydroprocessing catalysts of the present disclosure as hydrogenation components are the base metals of Group VIII, i.e., iron, cobalt, and nickel. In addition to these metals, other promoters may also be employed in conjunction therewith, including the metals of Group VIB, e.g., molybdenum and tungsten. The amount of hydrogenating metal in the catalyst can vary within wide ranges. Any amount between about 0.05 wt % and about 80 wt % may be used. In an aspect, molybdenum may be provided as a ground hydrotreating catalyst of particle size typically less than 60 mesh, preferably less than 100 mesh, more preferably less than 200 mesh, and even more preferably less than 400 mesh. The hydrotreating catalyst may be sulfided in situ or ex situ using any method mentioned throughout. In an aspect, molybdenum may be provided as an organic molybdenum such as molybdenum octoate or molybdenum dithiocarbamate which because it is oil or hydrocarbon soluble may be added directly to the hydrocarbon feed separately from or with the carbon particles. The molybdenum may react with sulfur provided in the hydrocarbon feed or an additive to produce molybdenum sulfide in the reactor which is the active form of the molybdenum catalyst.

Nickel may be provided as a catalyst in the way molybdenum is added.

In another aspect, the catalyst is a nickel and molybdenum sulfide catalyst where nickel is incorporated into the molybdenum sulfide molecular structure to enhance catalytic activity but may also form separate nickel sulfide phases with their own separate catalytic activity. In syntheses mentioned throughout that involve an aqueous solution, nickel can be added by simply introducing a nickel compound to the aqueous solution before heating to final synthesis temperature. In syntheses that involve a solid and gas or a solid and liquid method, nickel compounds may be physically mixed with the molybdenum compounds. For in situ formation of the nickel and molybdenum sulfide in the LPH, an oil-soluble nickel compound may be added directly to the feed or added from a separate line into the LPH. Nickel compounds that could be used include nickel octoate, nickel nitrate hexahydrate, nickel sulfate, nickel sulfite, nickel acetate tetrahydrate, nickel citrate hydrate, nickel hydroxide, or nickel hydroxide carbonate. The molar ratio of molybdenum to nickel can range from about 1:1 to about 5:1, preferably about 2:1 to about 4:1, or preferably about 2.5:1 to about 3.5:1.

The sulfur can be provided by a solid or liquid sulfiding agent that is added via line 131 into the petroleum stream in line 132 or added into a recycle stream to the reactor or premixed into the feed. Gaseous sulfiding agents like hydrogen sulfide can be added to the hydrogen line 144. Some preferred sulfiding agents are hydrogen sulfide, dimethyl disulfide, di-tert-butyl (poly)sulfide, dibenzyl disulfide, (di) allyl (di)sulfide, ammonium sulfite, dimethyl sulfite, dithiothreitol, elemental sulfur or thiourea.

An aqueous molybdenum may be derived from reacting MoO3 with an aqueous acid or basic solution such as phosphoric acid or ammonium hydroxide, respectively. Molybdenum in aqueous or oil-soluble liquid form in a volume selected to achieve target concentration may be dropped onto carbon particles which may serve as a carrier.

Without help from other catalysts, the concentration of the molybdenum in the liquid feeds to the LPH reactor may be more than 0 wppm and no more than about 2 weight % in the liquid feed, suitably no more than about 0.5 weight % in the liquid feed, and typically no more than about 2000 wppm in the liquid feed. In some cases, the concentration of molybdenum may be no less than 1000 wppm in the liquid feed, and preferably not less than 500 wppm of the feed.

In preferred embodiments where the catalyst contains both nickel and molybdenum, the concentration of the molybdenum in the liquid feed to the LPH reactor is the same as specified above. The concentration of the nickel in the liquid feed to the LPH reactor may be more than 0 wppm and no more than about 2 wt % in the liquid feed, suitably no more than about 0.5 weight % in the liquid feed, and typically no more than about 2000 wppm in the liquid feed. In some cases, the concentration of nickel may be no less than 1000 wppm in the liquid feed, and preferably not less than 500 wppm of the feed. By feed, all feed streams to the reactor are meant.

In preferred embodiments a stream containing catalyst may be recycled to the reactor. Thus the concentration of molybdenum in the reactor can be controlled at a steady state greater than the concentration of molybdenum in the liquid feed. The concentration of molybdenum in the reactor liquid is typically between 0.1 wt % and 10 wt %, preferably between 0.5 wt % and 7 wt % and more preferably between 2 wt % and 7 wt %, and even more preferably between 0.2 wt % and 3 wt %.

Conditions in the LPH reactor 150 generally include a temperature from about 315° C. (600° F.) to about 538° C. (1000° F.), or about 321° C. (610° F.) to about 482° C. (900° F.), or about 340° C. (644° F.) to about 470° C. (878° F.), a pressure from about 3.5 MPa (500 psig) to about 30 MPa (4351 psig), suitably 5.5 MPa (800 psig) to about 19.3 MPa (2800 psig), preferably 6.8 MPa (1000 psig) to about 13.8 MPa (2000 psig), or more preferably no more than about 10.3 MPa (1500 psig), and a reactor liquid residence time from about 0.1 to about 8 hrs, preferably 2 to about 6 hrs, or 1 to about 5 hrs, or about greater than 3 hrs.

In another exemplary embodiment of the present disclosure, the reactor 150 may be a continuous stirred tank reactor (CSTR). Operating conditions in the CSTR 150 may be as given above but may preferably include a temperature from about 300° C. (572° F.) to about 500° C. (932° F.), a pressure from about 6.8 MPa (1000 psig) to about 13.8 MPa (2000 psig), and a residence time of about 30 mins. to about 8 hours. From the reactor 150, the upgraded bio-oil stream is taken in line 154.

In an aspect, the reactor 150 may be selected from a bubble column reactor, a slurry reactor, and an ebullated bed reactor to facilitate contact and mixing of gases with liquid or slurry materials. Other types of reactors may be used to facilitate the contact and the mixing.

In another aspect, the reactor 150 may be a once-through reactor for processing the streams to produce the upgraded bio-oil stream.

In accordance with the present disclosure, the process 100 may comprise an analyzer 161 for analyzing the composition of various streams going in and out from the reactor 150. The analyzer 161 may be adapted to take corrective actions for adjusting the composition of one or more streams.

For a once-through reactor 150, the analyzer 161 may measure the composition of the material inside the once-through reactor 150. If the composition of the material does not fall within a predetermined range, adjustments can be made to the reactor conditions, feed conditions such as proportions of the bio-oil stream in line 122 and the stable oil stream comprising the petroleum stream in line 134 blended together.

When a recycle oil is employed, the composition of the material inside the reactor 150 may also be analyzed. If the composition of the material does not fall within a predetermined range, adjustments can be made to the reactor conditions, feed conditions such as proportions of the bio-oil stream in line 122 and the stable oil stream comprising the petroleum stream in line 134 and/or the recycle stream in line 163 fed to the reactor 150.

For example, the analyzer 161 may measure the composition of the reaction mixture inside the reactor 150 using, for example, one or more of infrared (IR) spectroscopy and nuclear magnetic resonance (NMR) spectroscopy. As per 1H NMR spectroscopy the reaction mixture inside the reactor 150 should comprise an aldehyde at a concentration of about 0 mol % H to about 3 mol % H or preferably about 0 mol % H to about 2 mol % H, or more preferably about 0 mol % H to about 1 mol % H. As per 13C NMR spectroscopy the reaction mixture inside the reactor 150 should comprise at least one of the group ketones and aldehydes at a concentration of about 0 mol % C to about 6 mol % C, or preferably about 0 mol % C to about 4 mol % C, or more preferably about 0 mol % C to about 2 mol % C; at least one of the group carboxylic acids and esters at a concentration of about 0 mol % C to about 6 mol % C or preferably about 0 mol % C to about 4 mol % C or more preferably about 0 mol % C to about 3 mol % C; and at least one of the group ethers, alcohols, phenyl methoxy groups, and carbohydrates at a concentration of about 0 mol % C to about 6 mol % C, or preferably about 0 mol % C to about 4 mol % C, or more preferably about 0 mol % C to about 2 mol % C.

The composition of the material inside the reactor 150 such as the reaction mixture may also be may also be characterized by a band area ratio of oxygenates measured by ATR-IR spectroscopy. In an exemplary embodiment, the composition of the reaction mixture inside the reactor 150 should comprise a ratio of oxygenates of one or more of a (C—O)/C ratio from about 0 to about 0.7 or preferably from about 0 to about 0.5, or more preferably from about 0 to about 0.4; a (C═O)/C ratio from about 0 to about 0.5 or preferably from about 0 to about 0.4 or more preferably from about 0 to about 0.3; an OH/C ratio from about 0 to 2.5, or preferably from about 0 to about 1.5, or more preferably from about 0 to about 1; and an O/C ratio from about 0 to 1.7; or preferably from about 0 to about 1 or more preferably from about 0 to about 0.6.

Applicants have discovered that producing an upgraded bio-oil stream that is missing or has reduced levels of specific functional groups eliminates the challenge of fresh bio-oil polymerization in reactor such a CSTR or a slurry reactor. Since the liquid contents of the reactor are depleted in specific functional groups, reactions that lead to bio-oil polymerization are suppressed. Applicants have analyzed the liquid effluent comprising the upgraded bio-oil from the reactor to identify the specific functional groups causing the bio-oil polymerization. In a well-mixed CSTR reactor, the liquid effluent of the reactor is representative of the liquid composition at all locations in the reactor. Applicants disclose various methods or tests to analyze the liquid effluent from the reactor including spectroscopy such as nuclear magnetic resonance (NMR) spectroscopy and attenuated total reflection-infrared (ATR-IR) spectroscopy. Other tests may include an acid number test and carbon-hydrogen-nitrogen-oxygen (CHNO) elemental analysis for example ASTM D5291 CHN, and ASTM UOP649 Oxygen. Acid number test may include TAN (total acid number) and CAN (carboxylic acid number). Using one or more of these tests, applicants identify the "bad actors" that cause bio-oil polymerization. Also, by identifying these groups, applicants distinguish an acceptable reactor effluent stream which can be used as-is or passed to further processing from an unacceptable reactor effluent stream which is insufficiently stable for downstream processing.

A recycle oil stream taken from the reactor effluent stream may be recycled to the reactor with recycled catalyst to both decrease the concentration of bad actors in the reactor and subject them to further conversion and produce the upgraded bio-oil stream. The recycle stream may be passed to the reactor and it may replace the petroleum feed stream. The upgraded bio-oil stream does not polymerize or generate char produced from the bio-oil polymerization in further processing in downstream processes such as hydrotreating, FCC, hydroprocessing, or reforming. Identification and tracking of the functional group evolution as a function of catalyst or process conditions allows one to target the chemical functional groups responsible for rapid polymerization and charring and provides the potential to eliminate them thereby enhancing the performance of the upgrading process.

Referring back to FIG. 1, the upgraded bio-oil stream in line 154 is passed to a hot separator 160. In the hot separator 160, heavy oil is separated from the light oil. A hot bottoms stream is taken in line 156 from the bottoms of the hot separator 160. In an exemplary embodiment, the hot bottoms stream in line 156 is a stable oil stream. The hot bottoms stream which contains catalyst is separated and taken in line 156 from the hot separator 160. The hot bottoms stream in line 156 comprises a majority of the catalyst for example all the catalyst exiting from the reactor 150 may be taken in the hot bottoms stream in line 156. In an aspect, the hot bottoms stream in line 156 may be characterized as a heavy oil stream comprising catalyst. Light oil is taken in a hot overhead stream in line 155 from the hot separator 160. Water is also separated in the hot separator 160 which is taken with the light oil in the hot overhead stream in line 155. The hot separator 160 may be run at a temperature of about 250° C. to about 400° C. and at a pressure of about the pressure of the reactor 150.

In an aspect, the stable oil stream in line 156 may be characterized by an acid number of no more than 60 mg KOH/g, preferably no more than 50 mg KOH/g, and more preferably no more than 40 mg KOH/g.

The hot bottoms stream in line 156 is recycled to the reactor 150. The stable oil stream in line 156 may be passed to a recycle tank 177. A recycle oil stream comprising a stable oil and the catalyst is taken in line 158 from the bottom of the recycle tank 177. A heavy oil stream in line 179 may be taken from a side of the recycle tank 177. A majority of the catalyst may be in the recycle oil stream in line 158. A controlled flow line 163 recycles a controlled flow of the recycle oil stream to the reactor 150 perhaps through a pump 157. A control valve 162 may be provided on the line 163 to regulate the flow of the recycle oil stream comprising stable oil in line 158 to the reactor 150 as described later in detail. A solid or liquid sulfiding agent may be added to the recycle stream in line 163 before recycling to the reactor 150.

In an embodiment, the stable, hot bottoms stream in line 156 may be recycled directly to the reactor 150.

In an aspect, the hot bottoms stream in line 156 may comprise a lower concentration of destabilizing functional groups such as oxygenates. The heavy oil stream in line 179 may be taken in such a way to avoid taking the bulk of the catalyst in this stream. In an aspect, the heavy oil stream in line 179 may be filtered, centrifuged, vacuum flashed, or wiped film evaporated to remove a heavy product stream lean of catalyst.

In an embodiment, the heavy oil stream in line 179 is passed to a catalyst separation vessel 136 for separating catalyst that may be present. In exemplary embodiment, the catalyst separation vessel 136 may be selected from a filtration vessel, a centrifuge, a vacuum distillation column, a wiped film evaporator, a centrifuge, or a combination thereof. In the catalyst separation vessel 136, the catalyst is separated from the heavy oil. A heavy oil product stream is taken in line 137 from the catalyst separation vessel 136. A concentrated catalyst stream comprising catalyst in heavy oil is taken in line 138 from the vessel 136. The heavy oil product stream in line 137 may be taken as a fuel oil product stream. The recycle oil stream in line 158 may be recycled to the reactor 150 to upgrade the bio-oil stream in the presence of the stable oil. In another exemplary embodiment, the recycle oil stream in line 158 may be combined with the concentrated catalyst stream in line 138 to provide a combined recycle oil stream in line 139 which is recycled to the reactor 150. The bio-oil stream in line 122 is reacted with the hydrogen in the presence of a catalyst and the stable oil in line 158 in the reactor 150 to produce the upgraded bio-oil stream in line 154.

A wiped film evaporator (WFE) uses a hinged blade with minimal clearance from the internal surface to agitate the flowing catalyst containing stream to effect separation of catalyst from heavy oil. In the catalyst separation vessel 136 comprising a WFE, the heavy oil stream in line 179 enters tangentially above a heated internal tube and is distributed evenly over an inner circumference of the tube by the rotating blade perhaps at vacuum. Catalyst particles spiral down the wall while bow waves developed by rotor blades generate highly turbulent flow and optimum heat flux. The heavy oil evaporates rapidly and vapors can flow either co-currently or counter-currently against the catalyst particles. In a simple WFE design, heavy oil may be condensed in a condenser located outside but as close to the evaporator as possible.

Other evaporative techniques may be used to separate the catalyst from the heavy oil in the catalyst separation vessel 136.

In an aspect, a fuel oil stream in line 166 may be taken from the heavy oil stream in line 137\. In an embodiment, the remaining heavy oil stream in line 184 may be processed in an FCC unit or a hydroprocessing unit or a reforming unit 180 to provide a product stream in line 182. The fuel oil stream in line 166 may have a boiling point curve typical of marine fuels known in the art, for instance the fuel oil stream in line 166 may have a T5 of about 150° C. to about 200° C. and a T90 of about 425° C. to about 600° C. The fuel oil stream in line 166 may be sent to a marine fuel oil pool.

In accordance with the present disclosure, the analyzer 161 may be in communication with the control valve 162 for opening the valve and releasing the controlled flow of the recycle oil stream in line 163. The chemical composition of the recycle oil stream in line 158 is monitored using analyzer 161. The content of the recycle oil stream can be monitored using an online analysis or by taking a sample and analyzing offline. The composition of the stable oil stream in line 158 is monitored to determine if the concentration of destabilizing functional groups lies within a certain predetermined range. If the concentration of destabilizing oxygenate functional groups exceeds this predetermined range, the process conditions of the reactor 150 may be changed to ensure that the upgraded bio-oil stream in line 154 from the reactor 150 produces a concentration of oxygenate functional groups in the predetermined range.

In an embodiment, the analyzer 161 measures oxygenate concentration. In a particular embodiment, the analyzer 161 measures the concentration of one or more oxygenates, the concentration of oxygen, or the acid number of one or more process streams. In an aspect, the analyzer 161 measures the concentration of one or more oxygenates, the concentration of oxygen, or the acid number of the recycle oil stream in line 158. The analyzer 161 may measure the oxygenate concentration of the recycle oil stream in line 158 by using one or more of NMR spectroscopy or ATR-IR spectroscopy. The analyzer may measure oxygen concentration through a carbon, hydrogen, nitrogen, oxygen (CHNO) elemental analysis as a proxy for oxygenate concentration. In the analyzer 161, the oxygenate concentration, oxygen concentration, or acid number is measured and the measured value(s) is compared with a predetermined range for the oxygenate concentration, oxygen concentration, and acid number, respectively. The analyzer may be an online analyzer, for example, an IR spectroscopic analyzer or samples may be taken and analyzed in offline analyses. If the measured concentration of the recycle oil stream in line 158 does not fall within the predetermined range, one or more of the operating conditions, temperature, pressure, or flow rates of the bio-oil stream, the petroleum stream, the hydrogen stream, the sulfiding agent stream, the catalyst stream, and/or the recycle rate or ratio of the recycle oil stream may be adjusted such that the measured concentration or acid number present in the recycle oil stream in line 158 is moved toward meeting the predetermined range of oxygenate concentration, oxygen concentration, or acid number. For example, if after measurement, the oxygenate concentration, oxygen concentration, or acid number of the recycle oil stream does not fall in the predetermined range, a higher proportion of the recycle oil stream may be recycled to the reactor 150. For this, the flow of the heavy oil stream in line 179 may be decreased by closing the valve 143 provided on the line 179. Decreasing the outflow rate of the heavy oil stream in line 137 results in a higher recycle rate of the recycle oil stream in line 158 and in the combined recycle oil stream in line 139. The outflow rate of the heavy oil stream in line 179 is decreased by closing the valve 143 until the measured oxygenate concentration, oxygen concentration or acid number present in the recycle oil stream in line 158 falls within the predetermined range of oxygenate concentration, oxygen concentration, or acid number.

The recycle oil stream in line 158 may be analyzed using one or more of the infrared (IR) spectroscopy and NMR spectroscopy by the analyzer 161 to determine if the recycle oil stream in line 158 has an acceptable quality.

In accordance with an exemplary embodiment, as per 1H NMR spectroscopy the recycle oil stream in line 158 should comprise at least one or more of an aldehyde at a concentration of about 0 mol % H to about 3 mol % H, or preferably about 0 mol % H to about 2 mol % H, or more preferably about 0 mol % H to about 1 mol % H. As per 13C NMR spectroscopy the recycle oil stream in line 158 should comprise at least one of the group ketones and aldehydes at a concentration of about 0 mol % C to about 6 mol % C, or preferably about 0 mol % C to about 4 mol % C, or more preferably about 0 mol % C to about 2 mol % C; at least one of the group carboxylic acids and esters at a concentration of about 0 mol % C to about 6 mol % C, or preferably about 0 mol % C to about 4 mol % C, or more preferably about 0 mol % C to about 3 mol % C; and at least one of the group ethers, alcohols, phenolic methoxys, and carbohydrates at a concentration of about 0 mol % C to about 6 mol % C, or preferably about 0 mol % C to about 4 mol % C, or more preferably about 0 mol % C to about 2 mol % C.

The recycle oil stream in line 158 may comprise elemental oxygen concentration of about 0 to about 20 wt %, preferably about 3 wt % to about 16 wt %, and more preferably about 2 wt % to about 13 wt %. Concentrations are on a non-solids basis.

The recycle oil stream in line 158 may also be characterized by a band area ratio of oxygenates measured by ATR-IR spectroscopy. In an exemplary embodiment, the recycle oil stream in line 158 should comprise a ratio of oxygenates of one or more of a (C—O)/C ratio from about 0 to about 0.7, or preferably from about 0 to about 0.5, or more preferably from about 0 to about 0.4; a (C═O)/C ratio from about 0 to about 0.5, or preferably from about 0 to about 0.4, or more preferably from about 0 to about 0.3; an OH/C ratio from about 0 to 2.5, or preferably from about 0 to about 1.5, or more preferably from about 0 to about 1; and an O/C ratio from about 0 to 1.7; or preferably from about 0 to about 1, or more preferably from about 0 to about 0.6.

The hot overhead stream comprising the light oil in line 155 may be cooled and charged to a cold separator 165. In the cold separator 165, gaseous components may be separated from the light oil. The gaseous components are separated and taken in line 164 from the cold separator 165. The cold overhead stream in line 164 may be purified to obtain a hydrogen stream which may be recycled to the reactor 150. A bottoms light oil stream comprising the upgraded bio-oil stream and aqueous components is taken in line 169 from the cold separator 165. The bottoms light oil stream in line 169 comprises water that should be separated from the upgraded bio-oil stream. The cold separator 165 may be operated at a temperature of about 0 to about 75° C. and at a pressure of about the pressure of the reactor 150.

In an embodiment, the bottoms light oil stream in line 169 is passed to an aqueous separator 147 for separating water from the upgraded bio-oil. Water is separated and taken in an aqueous bottoms line 148 from the aqueous separator 147. A light upgraded bio-oil stream is taken in line 159 from the aqueous separator 147 lean in water concentration. The aqueous separator 147 may be operated at a temperature of about 0 to about 75° C. and at a pressure of about 0 MPa (gauge) (0 psig) to about 1 Mpa (gauge) (150 psig).

The analyzer 161 may be in communication with the light upgraded bio-oil stream in line 159 to measure and analyze the concentration of destabilizing functional groups. The analyzer 161 may measure the concentration of one or more oxygenates, oxygen, or an acid number of the light upgraded bio-oil stream in line 159 as previously described. If the measured concentration of the functional groups present in the light upgraded bio-oil stream in line 159 does not fall within the predetermined range, one or more of the operating conditions, temperature, pressure, or flow rates of the bio-oil stream, the petroleum stream, the hydrogen stream, the sulfiding agent stream, the catalyst stream, and/or the recycle rate or ratio of the recycle stream may be adjusted such that the measured concentration or acid number present in the light upgraded bio-oil stream in line 159 is moved toward meeting the predetermined range of oxygenate concentration, oxygen concentration, or acid number. If after measurement, the measurement does not fall in the acceptable range, the recycle rate of the recycle oil stream in line 158 recycled to the reactor 150 may be increased and the outflow rate of the heavy oil stream in line 179 may be decreased as previously described.

The light upgraded bio-oil stream may be taken in line 168 from line 159 through an open control valve 167 which may be in communication with the analyzer 161.

In accordance with the present disclosure, the light upgraded bio-oil stream in line 159 may be analyzed at desired time intervals and analyzed offline using one or more of the infrared (IR) spectroscopy and NMR spectroscopy by the analyzer 161 to determine if the upgraded bio-oil stream has an acceptable quality. The NMR spectroscopy determines the physical and chemical properties of atoms or molecules. Proton (1H) NMR is one of the most widely used NMR methods. Different nuclei can also be detected by NMR spectroscopy, 1H (proton), 13C (carbon 13), 15N (nitrogen 15), 19F (fluorine 19), among many more. 1H and 13C are the most widely used. Phenolics may also be measured using NMR spectroscopy. Characterization of the light upgraded bio-oil stream with the help of the analyzer 161 may be used to determine the concentration of specific molecular functional groups including aldehydes, ketones, esters, ethers, phenolics, sugars, and carboxylic acids. Typically, the values of 1H and 13C are measured in mole % of the respective H or C atoms as per NMR spectroscopy.

In accordance with an exemplary embodiment, as per 1H NMR spectroscopy an acceptable concentration in the light upgraded bio-oil stream in line 159 should comprise aldehydes at a concentration of about 0 mol % to about 4 mol % H, or preferably about 0 mol % to about 2 mol % H, or more preferably about 0 mol % to about 1 mol % H. In accordance with another exemplary embodiment, as per 13C NMR spectroscopy the light upgraded bio-oil stream in line 159 should comprise at least one or more of at least one of the group ketones and aldehydes at a concentration of about 0 mol % C to about 6 mol % C, or preferably about 0 mol % C to about 5 mol % C, or more preferably about 0 mol % C to about 3.5 mol % C; at least one of the group carboxylic acids and esters at a concentration of about 0 mol % C to about 6 mol % C, or preferably about 0 mol % C to about 5 mol % C, or more preferably about 0 mol % C to about 4 mol % C; and at least one of the group ethers, alcohols, phenyl methoxy groups, and carbohydrates at a concentration of about 0 mol % C to about 11 mol % C, or preferably about 0 mol % C to about 9 mol % C, or more preferably about 0 mol % C to about 7 mol % C, or yet more preferably about 0 mol % C to about 5 mol % C.

In accordance with the present disclosure, the light upgraded bio-oil stream in line 159 may be characterized by a band area ratio of oxygenates measured by ATR-IR spectroscopy. In an exemplary embodiment, the light upgraded bio-oil stream in line 159 should comprise a ratio of oxygenates of one or more of a (C—O)/C ratio from about 0 to about 0.7, or preferably from about 0 to about 0.5, or more preferably from about 0 to about 0.4; a (C═O)/C ratio from about 0 to about 0.6, or preferably from about 0 to about 0.5, or more preferably from about 0 to about 0.4; an OH/C ratio from about 0 to 3, or preferably from about 0 to about 2, or more preferably from about 0 to about 1.5; and an O/C ratio from about 0 to 1.7; or preferably from about 0 to about 1.3, or more preferably from about 0 to about 0.8.

In an aspect of the present disclosure, the light upgraded bio-oil stream in line 168 may be separated into several streams and at least one of the streams may be passed to an FCC unit or a hydroprocessing unit or a reforming unit 180 or taken as a product stream.

In an embodiment, a stream may be taken from the light upgraded bio-oil stream in line 168 and charged to an FCC unit or a hydroprocessing unit or a reforming unit 180 to produce an intermediate blend or a fuel.

In an exemplary embodiment, the light upgraded bio-oil stream is taken in line 168 through the open control valve 167 and passed to the FCC unit 180 to provide a FCC product stream in line 182. In another exemplary embodiment, the light upgraded bio-oil stream is taken in line 168 through the open control valve 167 and passed to the hydroprocessing unit 180 to provide a hydroprocessing unit product stream in line 182. In yet another exemplary embodiment, the light upgraded bio-oil stream is taken in line 168 through the open control valve 167 and passed to the reforming unit 180 to produce a reformed product stream in line 182.

In a preferred embodiment, the light upgraded bio-oil stream in line 168 may be fractionated in a fractionation column 170 to separate the light upgraded bio-oil stream in line 168 into one or more hydrocarbon streams. The light upgraded bio-oil stream in line 168 may be passed to the fractionation column 170 to provide an overhead stream in line 171. The overhead stream in line 171 may be passed to a receiver 173 to further separate the overhead stream. From the receiver 173, LPG and light gases are separated in stream 172. The liquid stream in line 174 from the receiver 173 is separated into a reflux stream in line 175 and a naphtha stream in line 176. A kerosene stream may be taken in line 181 from a side of the fractionation column 170. The reflux stream in line 175 is recycled back to the fractionation column 170. From the bottoms of the fractionation column 170, a diesel stream may be taken in line 178. A reboiling stream may be taken from the diesel stream in line 178, heated in the reboiler 183 and a reboiled stream in line 185 may be passed to the fractionation column 170.

The fractionation column 170 may be operated at vacuum pressure. In an embodiment, fractionation column 170 may be operated at an overhead pressure of about 34 kPa (gauge) (5 psig) to about 173 kPa (gauge) (25 psig), and a bottoms temperature of about 500° C. (932° F.) to about 750° C. (1382° F.) or about 500° C. (932° F.) to about 600° C. (1112° F.).

A portion or an entirety of the naphtha stream in line 176 may be passed to the reforming unit 180 or another downstream processing unit.

In an embodiment, a portion or an entirety of the diesel stream in line 178 may be passed to the FCC unit 180 or the hydroprocessing unit 180 or the reforming unit 180.

In another embodiment, a portion or an entirety of the kerosene stream in line 181 may be passed to the FCC unit 180 or the hydroprocessing unit 180 or the reforming unit 180.

In an exemplary embodiment, the heavy oil stream in line 137 is passed to the FCC unit 180 or the hydroprocessing unit 180 or the reforming unit 180 to provide the product stream in line 182. In another exemplary embodiment, a marine fuel oil stream may be taken in line 166 from the heavy oil stream in line 137 while processing the remaining heavy oil stream in line 184 in the FCC unit or the hydroprocessing unit or the reforming unit 180.

In an aspect, the fuel oil stream in line 166 may be passed to a stripping column 190 to strip the light materials. A stripping media such as steam may be passed to the stripping column 190 in a stripping media line 191. Lighter material may be taken in an overhead line 192 from the stripping column 190. A stripped fuel oil stream may be taken from the bottoms of the stripping column 190 in line 194. The stripping column 190 may be operated at a bottoms temperature of about 75° C. to about 250° C. The fuel oil stream may be a marine fuel oil.

Although it is shown that the analyzer 161 is in communication with the light upgraded bio-oil stream in line 159 and the recycle oil stream in line 158, the analyzer 161 may be present on one or all of the naphtha stream in line 176, the kerosene stream in line 181 and the diesel stream in line 178 or elsewhere to measure the concentration of the functional groups in accordance with the present disclosure.

When the recycle oil stream in line 158 meets specifications, its recycle rate to the reactor 150 may be increased by opening the valve 162 more to diminish the flow rate of non-bio-based feed to the reactor 150 in line 134. In an aspect, the recycle oil stream in line 158 may be analyzed by the analyzer 161 independent of analyzing the light upgraded bio-oil stream in line 159 by the analyzer 161.

The recycle oil stream in line 158 may be transported back into the reactor 150 to blend the upgraded product with the reactor contents. The recycle rate of the recycle stream is selected so that the contents of the reactor consist of a specific ratio of fresh feed and upgraded feed that is determined by both the recycle rate and the residence time of the feed in the reactor 150. The recycle rate of the recycle oil stream in line 158 may be adjusted with the control valve 162 and passed to the reactor 150. In accordance with the present disclosure, the recycle oil stream is recycled to the reactor at a recycle rate to provide a ratio of a mixture inside the reactor 150 comprising the recycle oil stream in line 158, the bio-oil stream in line 122, and an upgraded bio-oil stream inside the reactor 150 of about 1:99 to about 80:20 or about 5:95 to about 85:15 by mass at start-up. When recycle to the reactor is begun in line 163, the volumetric flow rate of non-bio-oil feed may be decreased by as much as the recycle mass flow rate. When the recycle rate of recycle oil stream recycled to the reactor is increased, the flow rate of the non-bio-oil stream in line 134 may be decreased perhaps proportionately to produce the biomass-based feed stream having a predominance of the biomass feed. Thus, once the recycle oil stream starts blending with contents in the reactor 150, the amount of the petroleum stream 134 in mixed stream in line 142 is proportionately decreased by controlling the flow rate of the petroleum stream 134 through valve 135. In an aspect, the recycle rate of the recycle oil stream in line 158 is increased sufficiently to permit the flow rate of the petroleum stream in line 134 to be decreased to zero to produce the upgraded bio-oil stream in line 154 which is 100% biomass based. In an aspect, the recycle oil stream in line 158 may be passed and mixed into line 142 and then passed into reactor 150. In an embodiment, the recycle oil stream in line 158 is a bio-derived stream in its entirety.

As described above, one of the key aspects of present disclosure include minimizing presence of certain destabilizing oxygenated chemical functional groups in the reactor 150. The analyzing and control processes described above are non-exclusive methods to achieve levels of chemical functional groups in the reactor below predetermined thresholds. Any control method which maintains the concentration of predetermined chemical functional groups below predetermined thresholds may be used. For instance, prior experience operating this process in laboratory scale, pilot scale, or commercial scale reactors can be utilized to establish a tabulation or model of the relationship between process conditions and flow rates and the concentration of chemical functional groups in the reactor, in the recycle stream or in the product streams. The operation of this process can then utilize these correlations to adjust process conditions to meet desired product specifications and to maintain levels of oxygenated functional groups below thresholds to prevent polymerization.

The oxygenate concentration that may be measured may comprise one or more of an aldehyde, a ketone, an ester, an ether, a phenolic, a sugar, and a carboxylic acid. In accordance with the present disclosure, the phenolics comprise phenolic acids. An upgraded bio-oil stream having these properties within the predetermined range can reduce the occurrence of bio-oil polymerization significantly in feed equipment or in the LPH reactor and provide an upgraded bio-oil which can be used as a feed for various other processes or units such as an FCC unit or a hydroprocessing unit or a reforming unit 180 to produce blends and fuels. Alternatively, a portion of the upgraded bio-oil stream can be utilized as a fuel directly, for instance by fractionation of the upgraded bio-oil stream to remove lighter portions and from heavier product. The heavier product can be utilized as a marine fuel. In this case, utilization of the product as a marine fuel may require stripping, distillation, or other methods in order to reduce the flashpoint of the desired fuel.

Attenuated Total Reflectance (ATR) is an infrared (IR) spectroscopy which may also be used in accordance with the present disclosure. ATR-IR is a sampling technique in which the sample is placed in intimate contact with a crystal having a high index of refraction. The IR light is brought in from the bottom and reflected from the surface of the crystal. Samples were placed as-is onto the diamondcrystal for ATR IR spectrum collection (64 scans, 2 cm-1 resolution). The IR spectra may be collected on a Nicolet is 50 FTIR spectrometer, truncated and baseline corrected in GRAMS AI software, and deconvolved and plotted in OriginPro 2016.

For integration and deconvolution of the spectra, two approaches may be taken. Simple integration of spectral regions may be performed for different functional groups. The integration areas for various functional groups are measured. In accordance with the present disclosure, the following are roughly the integration areas for each functional group: about 3100-3695 cm-1 for hydroxyl groups, about 2800-2995 cm-1 for hydrocarbon groups, and about 1000-1315 cm-1 regions for methoxy groups. For the C═O and C═C regions, the spectra may be deconvolved by first baseline correcting the region, then fitting multiple peaks using the Origin Pro software. Spectra may not be normalized before deconvolution since there is no internal standard, thus, only area ratios may be used for sample comparison. The aromatic C═C band area is typically from the deconvolved bands in the region ranging from about 1500 cm-1 to about 1600 cm-1, the alkene C═C band area in the region ranging from about 1600 cm-1 to about 1700 cm-1, and the C═O band area in the region ranging from about 1700 cm-1 to about 1800 cm-1. Depending on the complexity of the region, some spectra could be deconvoluted into 6 bands or as many as 9 bands.

Total carbon "C" value may also be calculated. The total carbon "C" value is equal to the sum of the integrated regions of CHx stretching and C═C stretching so that C equals (CHx+C═C) integrated band areas. Similarly, the total oxygen "O" value is equal to the sum of the integrated regions of C═O and C—O stretching so that O equals (C═O+C—O) integrated band areas. All other band areas identify the specific molecular vibrations that they represent.

Based on the band area values of these functional groups, a band area ratio value is also calculated for various functional groups. Band area ratio is a unitless parameter which remains the same for all measuring instruments. In an embodiment, the band area ratios of various oxygenates are calculated to approximate the concentration of these functional groups. In an exemplary embodiment of the present disclosure, the (C—O)/C band area ratio should range from about 0 to about 0.4, the (C—O)/C band area ratio should range from about 0 to about 0.4, the OH/C band area ratio should range from about 0 to about 1.5, and/or the O/C band area ratio should range from about 0 to about 0.8.

Acid number is an additional suitable method for measuring carboxylic acid content. Briefly, acid number is obtained via typical potentiometric titration using a solution of tetra-n-butylammonium hydroxide and isopropanol as the titrant. A standard method of benzoic acid and N,N-dimethylformamide is run every 3 hours to ensure results. The sample is weighed and added to a beaker. The N,N-dimethylformamide solution is added to the beaker (internal standard) and the mixture is stirred under nitrogen for 5 mins before titration. In an embodiment, the carboxylic acid number should be below 60 mg KOH/g.

In addition to infrared spectroscopy, nuclear magnetic resonance spectroscopy and titration, oxygenates content in oils can further be measured by gas chromatography methods such as ASTM UOP960, GCxGC, or other chromatographic methods. Combustion analysis such as ASTM UOP649 can be used to measure total oxygenate content in an oil. Other methods known in the art may also be used.

EXAMPLES

Example 1

Bio-oil and petroleum VGO were stored in separate storage tanks 120 and 130 respectively. The petroleum VGO stream was pumped and kept well mixed in the mixer 140. The stream in line 142 was pre-loaded into the reactor 150. A soluble Mo-based catalyst or a solid Mo-based catalyst and a soluble sulfur compound was also blended into the stream. The reactor was heated at 2° C./h to 2° C./min with hydrogen flow until it reached the reaction temperature of 350-450° C. Once at reaction temperature, the blended feed was pumped at a specified flow rate to give a reactor residence time between 30 mins and 4 hours. Samples of an upgraded bio-oil stream were taken from the reactor at desired time intervals and analyzed using Infrared and/or Nuclear Magnetic Resonance spectroscopies.

Figure 2:
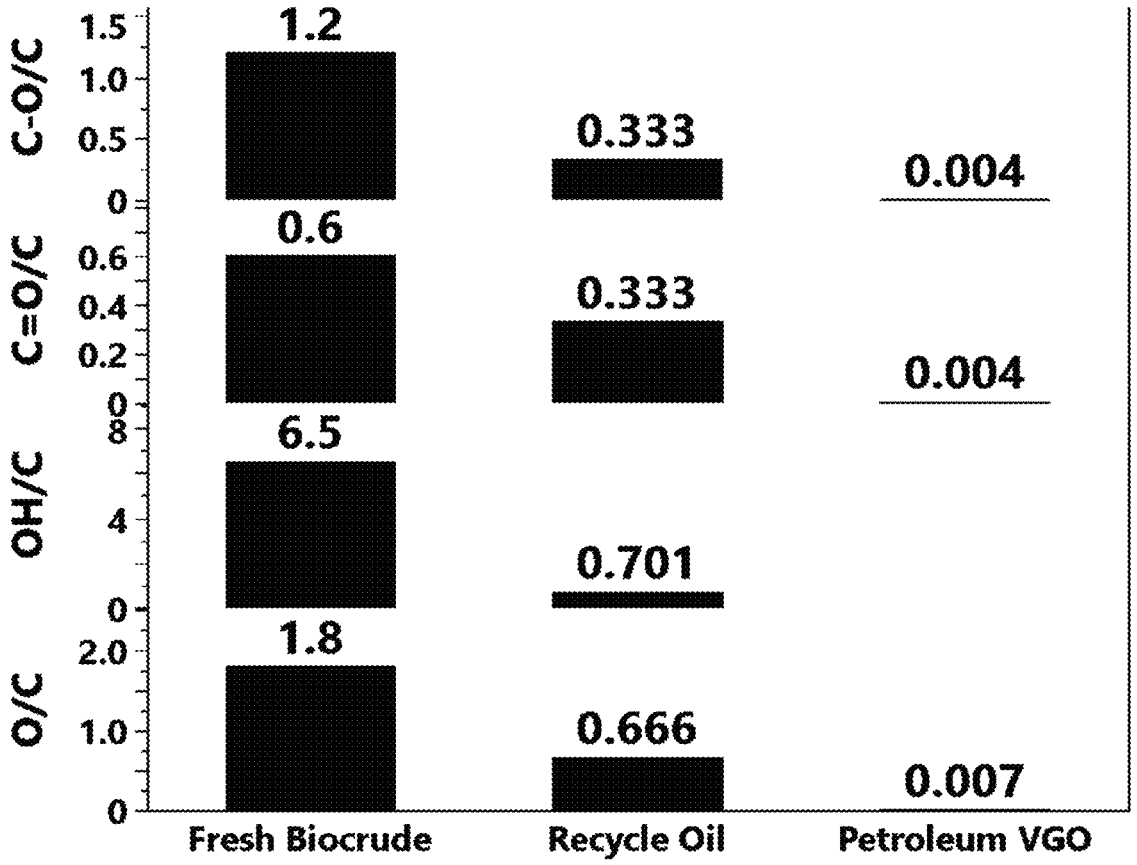
FIG. 2 shows an ATR-IR spectroscopy of band area ratios of different oils in accordance with the present disclosure.

After the once-through operation was stabilized, a recycle stream 162 was taken and started to blend the partially upgraded product back into the reactor 150. Once stable operation with recycle was established, the feed system started reducing the amount of petroleum VGO supplied to the reactor and increasing the amount of biocrude supplied to the reactor, such that final operation is 100% biocrude feed. Samples of the recycle stream were taken at desired time intervals and analyzed using Infrared and/or Nuclear Magnetic Resonance spectroscopies. Integrated ATR-IR spectroscopy band area ratios of the recycle stream, the bio-oil stream and the petroleum VGO stream were measured. The results are shown in FIG. 2. As shown in FIG. 2, the concentration of aldehyde, ketone, and organic acid demonstrated in terms of band area ratio were significantly reduced in the recycle oil stream as compared to the fresh biocrude. The values of the concentration of the functional groups in the recycle stream were within the desired range in accordance with the present disclosure.

Integrated areas of various 1H and 13C NMR spectral regions of the recycle stream, the bio-oil stream and the petroleum VGO stream were measured. The procedure for measuring the 1H and 13C NMR spectral regions was as below:

$^{1}$H Liquid State Procedure

NMR spectra of the samples were collected by employing a Bruker Avance Spectrometer operating at a frequency of 500.1317 for 1H experiments. The samples were prepared by dissolving 2-3 drops of bio-oil in 0.6 mL of chloroform-d with a trace quantity of tetramethylsilane being added as an internal reference. Quantitative results were obtained using a 90° pulse with 10 ms length and 10 seconds of delay between acquisitions. The number of scans was 128. Processing included baseline correction and the use of 1 Hz exponential line broadening before Fourier transformation. The spectra were further integrated by regions corresponding to the following lumped functional groups: 0.5-1.5 ppm alkanes, 1.5-3 ppm aliphatics alpha to heteroatom or unsaturation, 3-4.4 ppm alcohols, methylene-dibenzene, 4.4-6 ppm olefins, methoxys, carbohydrates, 6-7.18 ppm (hetero) aromatics, furans, 7.18-8.5 ppm (hetero) aromatics, 8.5-10.1 ppm aldehydes.

$^{13}$C Liquid State Procedure

NMR spectra of the samples were collected by employing a Bruker Avance Spectrometer operating at a frequency of 125.7715 for 13C experiments. The samples were prepared using a 50:50 (v/v) mixture of chloroform-d and bio-oil analyte. Additionally, a trace quantity of tetramethylsilane was added as an internal reference and chromium acetylacetonate was used as a relaxation agent. Quantitative results were obtained using an inverse-gated pulse sequence, and all 13C spectra were acquired by using 11.3 us pulses and 10 seconds of delay between acquisitions. The number of scans was 2048. Processing included baseline correction and the use of 3 Hz exponential line broadening before Fourier transformation. The spectra were further integrated by regions corresponding to the following lumped functional groups: 0-27 ppm short aliphatics, 27-54 ppm long and branch aliphatics, 54-94 ppm alcohols, ethers, phenyl methoxy groups, carbohydrates, 94-167 ppm aromatics, olefins, heteroaromatics, furans, 167-186 ppm esters, carboxylic acids, 186-225 ppm ketones, aldehydes.

Figure 3:
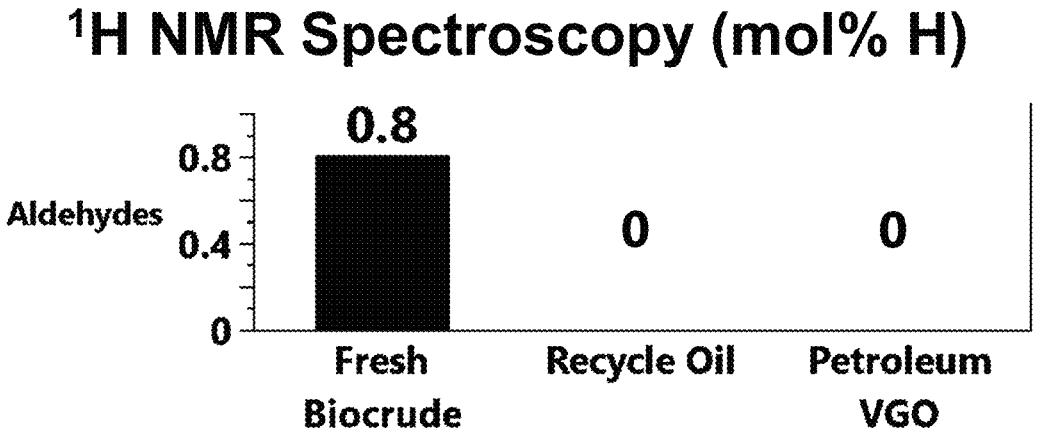
FIG. 3 shows integrated areas of various 1H NMR spectral regions of different oils in accordance with the present disclosure.

The results for the 1H NMR are shown in FIG. 3. As shown in FIG. 3, the concentration of aldehydes in the recycle oil stream as demonstrated in terms of mol % H was zero as compared to the fresh biocrude having 0.8 mol % H.

Figure 4:
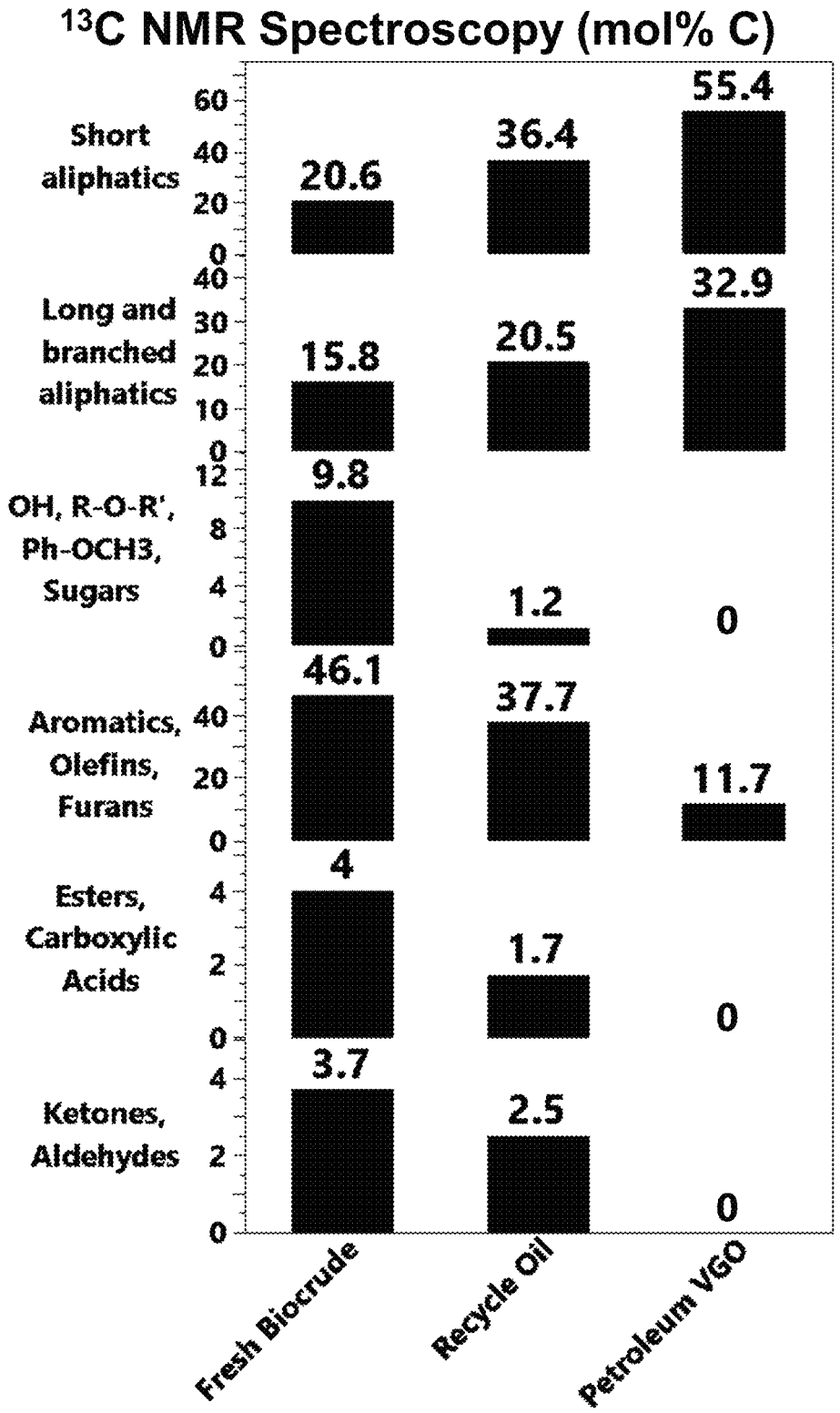
FIG. 4 shows integrated areas of various 13C NMR spectral regions of different oils in accordance with the present disclosure.

The results for 13C NMR are shown in FIG. 4. As shown in FIG. 4, the concentrations of ketones, aldehydes, and carboxylic acids as demonstrated in terms of mol % H or mol % C were significantly reduced as compared to the fresh biocrude. Also, the concentrations of desirable long and short aliphatics in the recycle oil stream were significantly higher as compared to the fresh biocrude. The concentration of the functional groups in the recycle stream as per the 1H and 13C NMR spectra were within the desired range evident from the mol % H or mol % C in accordance with the present disclosure.

Acid number of the recycle stream, and the bio-oil stream were measured based on the method as per Dence, C. W. (1992). Determination of Carboxyl Groups. In: Lin, S. Y., Dence, C. W. (eds) Methods in Lignin Chemistry. Springer Series in Wood Science. Springer, Berlin, Heidelberg. p. 458-464. https://doi.org/10.1007/978-3-642-74065-7. The details of the acid number test are as below:

Materials:

0.05N tetra-n-butylammonium hydroxide solution (TnBAH): Prepared by diluting 50.0 mL of 1.0N TnBAH (Aldrich, SAP #1014519, 100 mL) solution to 1.00 L in isopropanol. Components were mixed thoroughly before transferring the solution to a Dosimat bottle. The 1.0N TnBAH solution was blanketed with nitrogen and stored in the refrigerator.

Benzoic Acid: p-Hydroxybenzoic Acid, was stored in a dessicator when not in use.

Hydrochloric Acid additive solution: 2 mL of concentrated HCl was added to 100 mL of deionized water and mixed thoroughly. 4 mL of this solution was added to ~140 mL of dimethylformamide (DMF) for titration of samples.

Standardization of the Titrant:

0.15-0.20 g of dried benzoic acid was added into a titration beaker and the weight was recorded to the nearest 0.1 mg, 120 mL of DMF was added and titrate with the TnBAH solution. The standardization was done in duplicate. Normality was calculated to 3 significant figures as per the below formula:

$$N = \frac{\text{g Benzoic acid}}{(\text{mL titrant})(0.12212)}$$

Standardization was repeated every 3 hours when using this procedure.

Titration of Samples:

Prior to the first sample analysis, 0.05-0.08 g of p-hydroxybenzoic acid was weighed into a titration beaker. 140 mL of DMF and 4 mL of the HCl additive solution was added. The resultant solution was titrated through the 3rd inflection. This was the blank used to calculate the HCl correction, and can be used as a QC for the Phenolic Hydroxyl titrations.

0.3-0.4 g of lignin and 0.05-0.08 g of p-hydroxybenzoic acid were weighed into a titration beaker. 140 mL of DMF and 4 mL of the HCl additive solution were added. Beaker was blanketed with nitrogen and stirred for 5 minutes before titration. Titration was performed with 0.05N TnBAH to the 3rd inflection.

Calculations:

The theoretical titer of the internal standard used was calculated in the blank or sample titration:

$$a\ (\text{mL}) = \frac{\text{g } pHBA}{0.13812\ (N)}$$

and HCl interference was calculated from the blank $$c\ (\text{mL}) = [(\text{measured volume to reach } 2nd \text{ inflection of blank}) - (\text{measure } 1st \text{ inflection})] - (a\ (\text{mL, calculated above})),$$

then, $$\text{mEq carboxyl/g sample} = \frac{[(y) - (x) - (c) - (a)]N}{w}$$

$$\text{mEq phenolic hydroxyls/g sample} = \frac{[(z) - (y) - (a)]N}{w}$$

-continued where, $x$ = mL at first inflection point;

$y$ = mL at second inflection point;

$z$ = mL at third inflection point.

Figure 5:
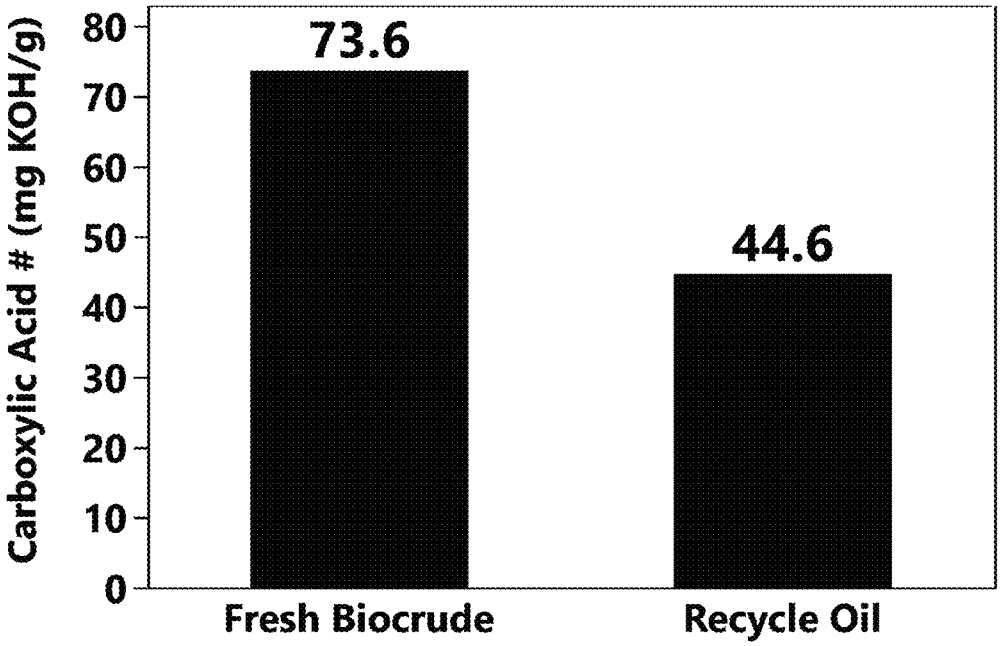
FIG. 5 shows carboxylic acid value of different oils in accordance with the present disclosure.

The foregoing method was used to measure acid number typically without use of the p-hydroxybenzoic acid internal standard for expedience. However, use of the internal standard is typically recommended. For acid number, carboxyl acid values were measured in the recycle stream, and the bio-oil stream. The results are shown in FIG. 5. As shown in FIG. 5, the carboxylic acid value was significantly reduced in the recycle stream as compared to the fresh biocrude. The values of the acid number for the recycle stream were within the desired range in accordance with the present disclosure.

Figure 6:
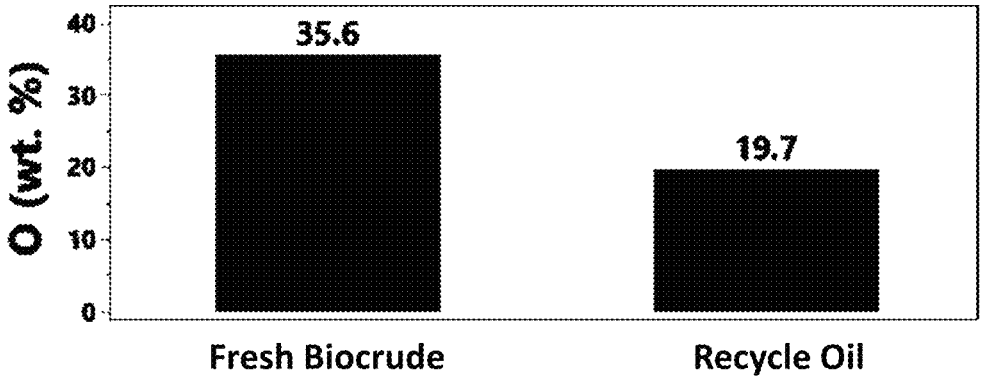
FIG. 6 shows oxygen concentration of different oils in accordance with the present disclosure.

An elemental analysis for oxygen concentration was also performed for the recycle stream, the bio-oil stream and the petroleum VGO stream. The elemental analysis was performed via ASTM method D5291 and ASTM UOP649. The results are shown in FIG. 6. As shown in FIG. 6, the oxygen concentration as demonstrated in terms of weight % was significantly reduced in the recycle oil stream as compared to the fresh biocrude. The oxygen concentration of the recycle stream was within the desired range in accordance with the present disclosure.

Example 2—A Successful Semi-Batch Autoclave Test

About 320 g of pyrolysis oil was loaded into a 500 mL autoclave reactor. Hydrotreating catalysts that were sulfided ex situ via H2S gas were ground to a <400 mesh particle size (fine powder). About 7.5 g of the ground hydrotreating catalyst was loaded into the autoclave reactor with the pyrolysis oil. The autoclave reactor was sealed and pressurized to 2000 psig of H2 with the H2 flowing at 700 sccm throughout the entirety of the experiment. Subsequently, the autoclave reactor was heated to 450° C. at 2° C./min while stirring at 600-1000 rpm and held at the indicated temperature for 2 hours. After the reaction time of 2 hours, the autoclave reactor was cooled to room temperature (20-25° C.). Once cooled, the autoclave reactor was opened and liquid from the reactor was collected. Similarly, a portion of the hydrocarbons became gas at the indicated reaction temperature and were swept out of the reactor via the H2 flow and were subsequently condensed into liquid in a condenser vessel downstream of the reactor at room temperature. After completion of the experiment, the liquid was drained from the condenser vessel. The condensed liquid product (light oil) had an oxygen concentration of about 11 wt % and the oil leftover in the reactor (heavy oil) had an oxygen concentration of about 9 wt %. Analysis of the oils by 1H and 13C NMR spectroscopy revealed the following concentrations of oxygen-containing functional groups (bad actors): 1) the light oil had 0.98 mol % C ketones and aldehydes, 0.69 mol % C esters and carboxylic acids, 0.0 mol % C of the sum of alcohols, ethers, phenyl methoxy groups, carbohydrates, and 0.0 mol % H aldehydes, 2) the heavy oil had 0.0 mol % C ketones and aldehydes, 0.0 mol % C esters and carboxylic acids, 0.0 mol % C of the sum of alcohols, ethers, phenyl methoxy groups, carbohydrates, and 0.0 mol % H aldehydes. Analysis of the oils by ATR-IR spectroscopy revealed the following band area ratios of oxygenates: 1) the light oil had a 0.26 (C—O)/C, a 0.11 (C—O)/C, a 0.61 OH/C, and a 0.37 O/C, 2) the heavy oil had a 0.08 (C—O)/C, a 0.03 (C═O)/C, a 0.21 OH/C, and a 0.11 O/C.

Example 3—a Successful Semi-Batch Autoclave Test Using a Hydrothermally Synthesized $Nimos_2$ Nanoparticle Catalyst A nanoparticle NiMoS2 catalyst was hydrothermally synthesized by combining water, ammonium heptamolybdate tetrahydrate, nickel nitrate hexahydrate, oxalic acid, and thiourea in an autoclave reactor, filling the autoclave with an N2 atmosphere and 500 psig of N2 pressure, heating to 220° C. while stirring at 800 rpm, and holding at temperature for 12 hours. The reactor was cooled and depressurized and the NiMoS2 nanoparticle catalyst was recovered suspended in the water. The catalyst was then dried into powder at 80° C. under N2 for 1 day. About 192 g of pyrolysis oil was loaded into a separate 300 mL autoclave reactor. About 2.0 g of the NiMoS2 nanoparticle catalyst was loaded into the autoclave reactor with the pyrolysis oil. The autoclave reactor was sealed and pressurized to 1850 psig of H2 with the H2 flowing at 700 sccm throughout the entirety of the experiment. Subsequently, the autoclave reactor was heated to 450° C. at 2° C./min while stirring at 600-1000 rpm and held at the indicated temperature for 2 hours. After the reaction time of 2 hours, the autoclave reactor was cooled to room temperature (20-25° C.). Once cooled, the autoclave reactor was opened and liquid from the reactor was collected. Similarly, a portion of the hydrocarbons became gas at the indicated reaction temperature and were swept out of the reactor via the H2 flow and were subsequently condensed into liquid in a condenser vessel downstream of the reactor at room temperature. After completion of the experiment, the liquid was drained from the condenser vessel. The condensed liquid product (light oil) had an oxygen concentration of about 13 wt % and the oil leftover in the reactor (heavy oil) had an oxygen concentration of about 9.6 wt %. Analysis of the oils by 1H and 13C NMR spectroscopy revealed the following concentrations of oxygen-containing functional groups (bad actors): 1) the light oil had 2.53 mol % C ketones and aldehydes, 1.59 mol % C esters and carboxylic acids, 0.60 mol % C of the sum of alcohols, ethers, phenyl methoxy groups, carbohydrates, and 0.01 mol % H aldehydes, 2) the heavy oil had 0.0 mol % C ketones and aldehydes, 0.0 mol % C esters and carboxylic acids, 0.0 mol % C of the sum of alcohols, ethers, phenyl methoxy groups, carbohydrates, and 0.0 mol % H aldehydes. Analysis of the oils by ATR-IR spectroscopy revealed the following band area ratios of oxygenates: 1) the light oil had a 0.31 (C—O)/C, a 0.29 (C═O)/C, a 0.73 OH/C, and a 0.61 O/C, 2) the heavy oil had a 0.18 (C—O)/C, a 0.02 (C═O)/C, a 0.77 OH/C, and a 0.20 O/C.

Example 4—Pilot Plant Continuous Bio-Oil Upgrading

A 2 L stirred tank reactor pilot plant, similar to the configuration shown in FIG. 1, was operated under several different testing regimes to continuously upgrade bio-oil or bio-oil and petroleum blends. Total seven tests were performed. Bio-oil, a sulfiding compound like dimethyl disulfide, and a molybdenum compound like Mo octoate, were blended together in a feed tank and fed to the reactor. A hydrogen gas stream was added into the bio-oil feed stream upstream of the reactor. After reaction, the product stream went through hot separators, cold separators, and an oil-water separator to finally provide a light oil product stream, a heavy oil product stream, and an aqueous waste stream. For runs that had a petroleum stream, the petroleum feed was kept in a separate feed tank and may also contain a sulfiding compound like dimethyl disulfide and/or a molybdenum compound like Mo octoate. The petroleum stream was fed separately from the bio-oil stream and added together upstream of the reactor at a similar location to where hydrogen gas was added into the feed stream. In all runs, the heavy oil product stream was recycled back into the reactor to provide a source of recycled, activated catalyst and deoxygenated oil. The operating conditions and other parameters of the upgrading process are summarized in Table 1 below:

TABLE 1

| | TEST 1 | TEST 2 | TEST 3 | TEST 4 | TEST 5 | TEST 6 | TEST 7 |
|---|---|---|---|---|---|---|---|
| T (° F.) | 690 | 692 | 690 | 667 | 690 | 672 | 647 |
| P (psig) | 1497 | 1298 | 1301 | 2491 | 1298 | 2490 | 2495 |
| LHSV Fresh feed ($hr^{-1}$) | 0.15 | 0.18 | 0.13 | 0.24 | 0.13 | 0.24 | 0.13 |
| Gas: Oil Fresh feed (scfb) | 14200 | 15700 | 17500 | 13900 | 16800 | 14300 | 19500 |
| Combined Feed Ratio (Fresh feed rate/total feed rate) | 1.00 | 1.00 | 1.32 | 1.38 | 1.16 | 1.16 | 1.00 |
| Mass Flow Fresh Feed (g/hr) | 350 | 400 | 310 | 541 | 312 | 527 | 276 |
| Mass Flow Recycle Oil (g/hr) | 0 | 0 | 100 | 205 | 50 | 82 | 0 |
| LHSV Fresh Feed + Recycle oil ($hr^{-1}$) | — | — | 0.18 | 0.34 | 0.16 | 0.27 | — |
| Gas: Oil (Fresh feed + Recycle oil) (scfb) | — | — | 13200 | 10100 | 14500 | 12400 | — |
| Flow Rate Light Oil (g/hr) | 70 | 88 | 96 | 142 | 96 | 163 | 53 |
| Flow Rate Heavy Oil (g/hr) | 40 | 100 | 19 | 17 | 30 | 54 | 56 |
| Petroleum: Bio-oil Ratio (g/g) | 0.17 | 0.33 | 0.00 | 0.00 | 0.00 | 0.00 | 0.19 |
| Catalyst Compound | Suspended Mo | Suspended Mo | Mo octoate | Mo octoate | Mo octoate | Mo octoate | Suspended Mo, Mo octoate |
| Sulfiding Compound | TBPS | TBPS | TBPS, H2S | TBPS | TBPS | TBPS | TBPS |

The results of the upgrading process for the seven tests are provided in Table 2 below:

TABLE 2

| | TEST 1 | TEST 2 | TEST 3 | TEST 4 | TEST 5 | TEST 6 | TEST 7 |
|---|---|---|---|---|---|---|---|
| | Recycle Oil/Heavy Oil | | | | | | |
| Specific Gravity (ASTM D4052) | 0.961 | 0.982 | 1.085 | 1.035 | 0.989 | 1.080 | 1.038 |
| Carbon by CHN (wt %) | not measured | not measured | 79.6 | 78 | 81.8 | 78.2 | 64.4 |
| Hydrogen by CHN (wt %) | not measured | not measured | 9.3 | 9.6 | 9.4 | 8.7 | 8.68 |
| Oxygen by U649 (wt %) | 1.45 | 1.83 | 5.57 | 6.37 | 5.94 | 7.08 | 12.8 |
| Carboxylic Acid Number (mg KOH/g) | 0 (none detected) | 1.02 | 9.46 | 7.31 | 7.74 | 12.1 | 45.8 |
| Pheolic Acid Number (mg KOH/g) | 11.0 | 16.5 | 115.9 | 84.6 | 119.0 | 111.8 | 53.1 |

TABLE 2-continued

| | TEST 1 | TEST 2 | TEST 3 | TEST 4 | TEST 5 | TEST 6 | TEST 7 |
|---|---|---|---|---|---|---|---|
| ICP Mo (wt %) | 0.72 | 1.48 | 1.58 | 1.26 | 0.8 | 1.4 | 0.55 |
| Sulfur by Combustion (wt %) | 1.65 | not measured | 0.57 | 2.07 | 0.31 | 1.02 | 0.90 |
| Toluene Insolubles (wt %) | 3.8 | 2.91 | 5.41 | 4.2 | 1.5 | 4.5 | 3.3 |
| Aldehydes (mol % H) | not measured | not measured | not measured | 0.001 | 0.0003 | 0 (not detected) | not measured |
| Ketones, Aldehydes (mol % C) | not measured | not measured | not measured | 0 (not detected) | 0 (not detected) | 0 (not detected) | not measured |
| Esters, Carboxylic Acids (mol % C) | not measured | not measured | not measured | 0 (not detected) | 0 (not detected) | 0 (not detected) | not measured |
| Alcohols, Ethers, Phenolic Methoxys, Carbohydrates (mol % C) | not measured | not measured | not measured | 1.58 | 0 (not detected) | 0.91 | not measured |
| C—O/C (IR Area Ratio) | not measured | not measured | not measured | 0.05 | 0.16 | 0.14 | not measured |
| C═O/C (IR Area Ratio) | not measured | not measured | not measured | 0.01 | 0.06 | 0.08 | not measured |
| OH/C (IR Area Ratio) | not measured | not measured | not measured | 0.18 | 0.46 | 0.49 | not measured |
| O/C (IR Area Ratio) | not measured | not measured | not measured | 0.24 | 0.68 | 0.71 | not measured |
| Upgraded bio-oil stream | | | | | | | |
| Specific Gravity | 0.823 | 0.854 | 0.891 | 0.895 | 0.901 | 0.910 | 0.889 |
| Carbon by CHN (wt %) | 83.7 | 81.9 | 75.2 | 72.6 | 73.3 | 69.8 | 67.8 |
| Hydrogen by CHN (wt %) | 12.5 | 11.2 | 11.2 | 11.2 | 11.1 | 10.4 | 10.9 |
| Oxygen by U649 (wt %) | 2.72 | 5.3 | 10.9 | 12.6 | 13.7 | 14.4 | 16.8 |
| Carboxylic Acid Number (mg KOH/g) | 2.16 | 4.87 | 35.9 | 29.8 | 42.3 | 40.3 | 36.1 |
| Pheolic Acid Number (mg KOH/g) | 61 | 97.3 | 93.6 | 64.7 | 79.5 | 72.2 | 34.9 |
| Aldehydes (mol % H) | not measured | 0 (not detected) | not measured | 0 (not detected) | not measured | 0.032 | 0.04 |
| Ketones, Aldehydes (mol % C) | not measured | 0.19 | not measured | 0.32 | not measured | 3.08 | 2.73 |
| Esters, Carboxylic Acids (mol % C) | not measured | 0.19 | not measured | 0.21 | not measured | 2.45 | 3.43 |
| Alcohols, Ethers, Phenolic Methoxys, Carbohydrates (mol % C) | not measured | 0.47 | not measured | 1.72 | not measured | 4.60 | 6.81 |
| C—O/C (IR Area Ratio) | not measured | 0.13 | not measured | 0.15 | not measured | 0.28 | 0.33 |
| C═O/C (IR Area Ratio) | not measured | 0.03 | not measured | 0.12 | not measured | 0.28 | 0.31 |
| OH/C (IR Area Ratio) | not measured | 0.32 | not measured | 0.85 | not measured | 0.80 | 1.04 |
| O/C (IR Area Ratio) | not measured | 0.48 | not measured | 1.12 | not measured | 1.37 | 1.69 |
| Reactor Composition | | | | | | | |
| Specific Gravity | 1.007 | 1.019 | 1.061 | 1.077 | 1.093 | 1.117 | 1.054 |
| Carbon by CHN (wt %) | not measured | not measured | 77.1 | 81.3 | not measured | not measured | 74.4 |
| Hydrogen by CHN (wt %) | not measured | not measured | 8.4 | 10.1 | not measured | not measured | 9.3 |

TABLE 2-continued

| | TEST 1 | TEST 2 | TEST 3 | TEST 4 | TEST 5 | TEST 6 | TEST 7 |
|---|---|---|---|---|---|---|---|
| Oxygen by U649 (wt %) | 1.4 | 4.75 | 5.44 | 6.36 | 5.74 | 7.46 | 7.2 |
| ICP Mo (wt %) | not measured | not measured | 2.36 | 1.70 | 1.34 | 2.26 | 1.05 |
| Sulfur by Combustion (wt %) | 2.8 | 2.05 | 2.95 | not measured | 1.59 | not measured | 1.28 |
| Toluene Insolubles (wt %) | not measured | not measured | 6.42 | 5.79 | 5.11 | 9.06 | 7.3 |
| Aldehydes (mol % H) | not measured | not measured | 0.002 | not measured | not measured | not measured | not measured |
| Ketones, Aldehydes (mol % C) | not measured | not measured | 0 (not detected) | not measured | not measured | not measured | not measured |
| Esters, Carboxylic Acids (mol % C) | not measured | not measured | 0 (not detected) | not measured | not measured | not measured | not measured |
| Alcohols, Ethers, Phenolic Methoxys, Carbohydrates (mol % C) | not measured | not measured | 0 (not detected) | not measured | not measured | not measured | not measured |
| C–O/C (IR Area Ratio) | not measured | not measured | 0.14 | not measured | not measured | not measured | not measured |
| C═O/C (IR Area Ratio) | not measured | not measured | 0.02 | not measured | not measured | not measured | not measured |
| OH/C (IR Area Ratio) | not measured | not measured | 0.44 | not measured | not measured | not measured | not measured |
| O/C (IR Area Ratio) | not measured | not measured | 0.6 | not measured | not measured | not measured | not measured |

Integrated areas of various 1H and 13C NMR spectral regions of the upgraded bio-oil stream with and without recycle streams were measured to calculate the concentration of oxygenate groups. The oxygenate groups and the calculated values are tabulated in Table 2 above. IR spectroscopy band area ratios were measure on dry basis. As evident from Table 2, the concentration of oxygenates including aldehyde, ketone, and hydroxyl groups were all within the predetermined desired ranges. Acid numbers were measured using the method as described in the Example 1 above.

SPECIFIC EMBODIMENTS

While the following is described in conjunction with specific embodiments, it will be understood that this description is intended to illustrate and not limit the scope of the preceding description and the appended claims.

A first embodiment of the present disclosure is a process for upgrading a bio-oil stream comprising reacting a bio-oil stream with hydrogen in the presence of a catalyst in a reactor to produce an upgraded bio-oil stream; and/or charging the upgraded bio-oil stream to an FCC unit, a hydroprocessing unit, or a reforming unit to produce an intermediate blend or a fuel stream or taking a fuel oil stream from the upgraded bio-oil stream. An embodiment of the present disclosure is one, any or all of prior embodiments in this paragraph up through the first embodiment in this paragraph further comprising separating the catalyst from the upgraded bio-oil stream. An embodiment of the present disclosure is one, any or all of prior embodiments in this paragraph up through the first embodiment in this paragraph, wherein the upgraded bio-oil stream is used directly as the intermediate blend or the fuel oil stream. An embodiment of the present disclosure is one, any or all of prior embodiments in this paragraph up through the first embodiment in this paragraph, wherein the upgraded bio-oil comprises at least one or more of an aldehyde at a concentration of about 0 mol % H to about 4 mol % H, at least one of the group ketones and aldehydes at a concentration of about 0 mol % C to about 6 mol % C, at least one of the group carboxylic acids and esters at a concentration of about 0 mol % C to about 6 mol % C, at least one of the group ethers, alcohols, phenyl methoxy groups, and carbohydrates at a concentration of about 0 mol % C to about 11 mol % C. An embodiment of the present disclosure is one, any or all of prior embodiments in this paragraph up through the first embodiment in this paragraph, wherein the upgraded bio-oil comprises a ratio of oxygenates of one or more of a (C—O)/C ratio from about 0 to about 0.7, a (C═O)/C ratio from about 0 to about 0.6, an OH/C ratio from about 0 to 3, and an O/C ratio from about 0 to 1.7. An embodiment of the present disclosure is one, any or all of prior embodiments in this paragraph up through the first embodiment in this paragraph further comprising passing the upgraded bio-oil stream to a hot separator; and separating the catalyst from the upgraded bio-oil stream in a hot bottoms stream in the hot separator to provide a hot overhead stream comprising the light upgraded bio-oil stream. An embodiment of the present disclosure is one, any or all of prior embodiments in this paragraph up through the first embodiment in this paragraph further comprising passing the hot overhead stream to a cold separator to separate gaseous components and provide a bottoms light oil stream; separating water from the bottoms light oil stream to produce the light upgraded bio-oil stream. An embodiment of the present disclosure is one, any or all of prior embodiments in this paragraph up through the first embodiment in this paragraph further comprising taking a heavy oil stream and a recycle oil stream comprising the catalyst from the hot bottoms stream; and recycling the recycle oil stream to the reactor to provide the upgraded bio-oil stream. An embodiment of the present disclosure is one, any or all of prior embodiments in this paragraph up through the first embodiment in this paragraph further comprising separating catalyst from the heavy oil stream to provide a heavy oil product stream and a separated catalyst stream; combining the separated catalyst stream with the recycle oil stream to provide a combined recycle oil stream; and recycling the combined recycle oil stream to the reactor to provide the upgraded bio-oil stream. An embodiment of the present disclosure is one, any or all of prior embodiments in this paragraph up through the first embodiment in this paragraph, wherein the heavy oil stream is passed to a filtration vessel, a vacuum distillation column, a wiped film evaporator, a centrifuge, or a combination thereof for separating the catalyst. An embodiment of the present disclosure is one, any or all of prior embodiments in this paragraph up through the first embodiment in this paragraph further comprising operating the reactor at a temperature of about 300° C. to about 500° C. An embodiment of the present disclosure is one, any or all of prior embodiments in this paragraph up through the first embodiment in this paragraph further comprising separating the upgraded bio-oil stream into several streams and charging at least one of the streams to the FCC unit, the hydroprocessing unit, or the reforming unit. An embodiment of the present disclosure is one, any or all of prior embodiments in this paragraph up through the first embodiment in this paragraph, wherein the reactor is a once through reactor for producing the upgraded bio-oil stream. An embodiment of the present disclosure is one, any or all of prior embodiments in this paragraph up through the first embodiment in this paragraph, wherein at least 50 wt % of the upgraded bio-oil stream is bio-derived.

A second embodiment of the present disclosure is a process for upgrading a bio-oil stream, comprising reacting a bio-oil stream with hydrogen in the presence of a catalyst in a reactor to produce an upgraded bio-oil stream; separating catalyst from the upgraded bio-oil stream to produce a light upgraded bio-oil stream; and charging the light upgraded bio-oil stream to an FCC unit, a hydroprocessing unit, or a reforming unit to produce an intermediate blend or a fuel stream or taking a fuel oil stream from the upgraded bio-oil stream. An embodiment of the present disclosure is one, any or all of prior embodiments in this paragraph up through the second embodiment in this paragraph further comprising passing the upgraded bio-oil stream to a hot separator; separating the catalyst from the upgraded bio-oil stream in a hot bottoms stream in the hot separator to provide a hot overhead stream comprising the light upgraded bio-oil stream; and separating water from the hot overhead stream to provide the light upgraded bio-oil stream. An embodiment of the present disclosure is one, any or all of prior embodiments in this paragraph up through the second embodiment in this paragraph further comprising passing the hot overhead stream to a cold separator to separate gaseous components and provide a bottoms light oil stream; and separating water from the bottoms light oil stream to produce the light upgraded bio-oil stream. An embodiment of the present disclosure is one, any or all of prior embodiments in this paragraph up through the second embodiment in this paragraph further comprising taking a recycle oil stream comprising the catalyst from the hot bottoms stream; and recycling the recycle oil stream to the reactor to provide the upgraded bio-oil stream.

A third embodiment of the present disclosure is a process for upgrading a bio-oil stream comprising mixing a bio-oil stream and a petroleum stream at a mass ratio of the bio-oil stream and the petroleum stream of about less than 1 at a start-up to provide a mixed stream; reacting the mixed stream with hydrogen in the presence of a catalyst in a reactor to produce an upgraded bio-oil stream; charging the upgraded bio-oil stream to an FCC unit, a hydroprocessing unit, or a reforming unit to produce an intermediate blend or a fuel stream; or taking a fuel oil stream from the upgraded bio-oil stream. An embodiment of the present disclosure is one, any or all of prior embodiments in this paragraph up through the third embodiment in this paragraph, wherein the mass ratio of the bio-oil stream and the petroleum stream is in the range from about 0:100 to about 80:20 at the start-up.

Without further elaboration, it is believed that using the preceding description that one skilled in the art can utilize the present disclosure to its fullest extent and easily ascertain the essential characteristics of this disclosure, without departing from the spirit and scope thereof, to make various changes and modifications of the disclosure and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for upgrading a bio-oil stream comprising:

passing a catalyst stream to a reactor;

reacting a bio-oil stream with hydrogen in the presence of a metal sulfide catalyst from said catalyst stream in said reactor to produce an upgraded bio-oil stream; and charging said upgraded bio-oil stream to an FCC unit, a hydroprocessing unit, or a reforming unit to produce an intermediate blend or a fuel stream; or taking a fuel oil stream from said upgraded bio-oil stream.

2. The process of claim 1 further comprising separating the catalyst from said upgraded bio-oil stream.

3. The process of claim 1, wherein said upgraded bio-oil stream is used directly as the intermediate blend or the fuel oil stream.

4. The process of claim 1, wherein the upgraded bio-oil comprises at least one or more of an aldehyde at a concentration of about 0 mol % H to about 4 mol % H, at least one of the group ketones and aldehydes at a concentration of about 0 mol % C to about 6 mol % C, at least one of the group carboxylic acids and esters at a concentration of about 0 mol % C to about 6 mol % C, at least one of the group ethers, alcohols, phenyl methoxy groups, and carbohydrates at a concentration of about 0 mol % C to about 11 mol % C.

5. The process of claim 1, wherein the upgraded bio-oil comprises a ratio of oxygenates of one or more of a (C—O)/C ratio from about 0 to about 0.7, a (C═O)/C ratio from about 0 to about 0.6, an OH/C ratio from about 0 to 3, and an O/C ratio from about 0 to 1.7.

6. The process of claim 2 further comprising:

passing said upgraded bio-oil stream to a hot separator; and separating the catalyst from said upgraded bio-oil stream in a hot bottoms stream of the hot separator to provide a hot overhead stream comprising said light upgraded bio-oil stream.

7. The process of claim 6 further comprising:

passing said hot overhead stream to a cold separator to separate gaseous components and provide a bottoms light oil stream;

separating water from said bottoms light oil stream to produce said light upgraded bio-oil stream.

8. The process of claim 6 further comprising:

taking a heavy oil stream and a recycle oil stream comprising the catalyst from said hot bottoms stream; and recycling the recycle oil stream to the reactor to provide said upgraded bio-oil stream.

9. The process of claim 8 further comprising:

separating catalyst from said heavy oil stream to provide a heavy oil product stream and a separated catalyst stream;

combining said separated catalyst stream with said recycle oil stream to provide a combined recycle oil stream; and recycling said combined recycle oil stream to the reactor to provide said upgraded bio-oil stream.

10. The process of claim 9, wherein said heavy oil stream is passed to a filtration vessel, a vacuum distillation column, a wiped film evaporator, a centrifuge, or a combination thereof for separating the catalyst.

11. The process of claim 1 further comprising operating said reactor at a temperature of about 300° C. to about 500° C.

12. The process of claim 1 further comprising separating said upgraded bio-oil stream into several streams and charging at least one of said streams to said FCC unit, said hydroprocessing unit, or said reforming unit.

13. The process of claim 1, wherein the reactor is a once through reactor for producing said upgraded bio-oil stream.

14. The process of claim 8, wherein at least 50 wt % of said upgraded bio-oil stream is bio-derived.

15. A process for upgrading a bio-oil stream, comprising:

reacting a bio-oil stream with hydrogen in the presence of a catalyst in a reactor to produce an upgraded bio-oil stream;

separating catalyst from said upgraded bio-oil stream to produce a light upgraded bio-oil stream;

recycling a recycle oil stream comprising the catalyst to the reactor; and charging said light upgraded bio-oil stream to an FCC unit, a hydroprocessing unit, or a reforming unit to produce an intermediate blend or a fuel stream; or taking a fuel oil stream from said upgraded bio-oil stream.

16. The process of claim 15 further comprising:

passing said upgraded bio-oil stream to a hot separator;

separating the catalyst from said upgraded bio-oil stream in a hot bottoms stream in the hot separator to provide a hot overhead stream comprising said light upgraded bio-oil stream; and separating water from said hot overhead stream to provide said light upgraded bio-oil stream.

17. The process of claim 16 further comprising:

passing said hot overhead stream to a cold separator to separate gaseous components and provide a bottoms light oil stream; and separating water from said bottoms light oil stream to produce said light upgraded bio-oil stream.

18. The process of claim 16 further comprising:

taking said recycle oil stream comprising the catalyst from said hot bottoms stream; and recycling the recycle oil stream to the reactor to provide said upgraded bio-oil stream.

19. A process for upgrading a bio-oil stream comprising:

mixing a bio-oil stream and a petroleum stream at a mass ratio of said bio-oil stream and said petroleum stream of about 0:100 to about 80:20 at a start-up to provide a mixed stream;

reacting said mixed stream with hydrogen in the presence of a catalyst in a reactor to produce an upgraded bio-oil stream;

replacing the petroleum stream with a recycle oil stream taken from said upgraded bio-oil stream; and charging said upgraded bio-oil stream to an FCC unit, a hydroprocessing unit, or a reforming unit to produce an intermediate blend or a fuel stream;

or taking a fuel oil stream from said upgraded bio-oil stream.

20. The process of claim 19, wherein the mass ratio of said bio-oil stream and said petroleum stream is in the range of less than about 1 at the start-up.

21. A process for upgrading a bio-oil stream comprising:

reacting a bio-oil stream with hydrogen in the presence of a metal sulfide catalyst in a reactor to produce an upgraded bio-oil stream;

passing said upgraded bio-oil stream to a hot separator; and separating the catalyst from said upgraded bio-oil stream in a hot bottoms stream of the hot separator to provide a hot overhead stream comprising a light upgraded bio-oil stream; and charging said light upgraded bio-oil stream to an FCC unit, a hydroprocessing unit, or a reforming unit to produce an intermediate blend or a fuel stream; or taking a fuel oil stream from said light upgraded bio-oil stream.

* * * * *